US008052481B2

(12) United States Patent
Azad et al.

(10) Patent No.: US 8,052,481 B2
(45) Date of Patent: Nov. 8, 2011

(54) ELECTRICAL CONNECTOR RECEPTACLE

(75) Inventors: Vikas Azad, Novi, MI (US); Yeong Taur Eow, Singapore (SG); Ping Chen, West Bloomfield Hills, MI (US)

(73) Assignee: J.S.T. Corporation, Farmington Hills, MI (US)

( * ) Notice: Subject to any disclaimer, the term of this patent is extended or adjusted under 35 U.S.C. 154(b) by 85 days.

(21) Appl. No.: 12/433,393

(22) Filed: Apr. 30, 2009

(65) Prior Publication Data

US 2010/0279555 A1 Nov. 4, 2010

(51) Int. Cl.
*H01R 24/00* (2006.01)

(52) U.S. Cl. ..... 439/676; 439/695

(58) Field of Classification Search ..... 439/676, 439/349, 607.01, 607.02, 620.26, 620.29, 439/695, 701, 709, 98, 108, 607.41, 607.52
See application file for complete search history.

(56) References Cited

U.S. PATENT DOCUMENTS

| | | | | |
|---|---|---|---|---|
| 5,073,127 | A | 12/1991 | Daly et al. | |
| 5,562,502 | A | 10/1996 | Kourimsky | |
| 5,618,209 | A | 4/1997 | Lin et al. | |
| 5,820,413 | A | 10/1998 | Yamada et al. | |
| 6,652,321 | B2 * | 11/2003 | Liu | 439/620.3 |
| 7,632,148 | B1 * | 12/2009 | Kawamura et al. | 439/607.41 |
| 2001/0036773 | A1 | 11/2001 | Suzuki | |
| 2004/0166737 | A1 * | 8/2004 | Cheng et al. | 439/621 |
| 2007/0270034 | A1 | 11/2007 | Belopolsky et al. | |
| 2010/0015851 | A1 * | 1/2010 | Wu | 439/607.01 |

FOREIGN PATENT DOCUMENTS

| | | | |
|---|---|---|---|
| DE | 10 2006 048 318 | A1 | 4/2008 |
| EP | 0 891 015 | A2 | 1/1999 |
| EP | 0891015 | A2 * | 1/1999 |
| FR | 2 685 826 | A1 | 7/1993 |

OTHER PUBLICATIONS

PCT/ISA/220, PCT/ISA/210, PCT/ISA/237; App. No. PCT/USA2010/032776, Sep. 17, 2010 (14 pages).

* cited by examiner

*Primary Examiner* — Tulsidas C Patel
*Assistant Examiner* — Travis Chambers
(74) *Attorney, Agent, or Firm* — Rader, Fishman & Grauer PLLC

(57) ABSTRACT

An electrical connector receptacle includes a shield cover, a terminal unit and a fastener structure. The shield cover defines a cavity and an opening into the cavity and has a base panel with a base panel hole formed therethrough. The terminal unit has a first terminal unit mounting block having a first terminal unit mounting block hole, a second terminal unit mounting block having a second terminal unit mounting block hole, a first terminal assembly and a second terminal assembly. The first and second terminal unit mounting blocks are connected together in a stacked manner and are disposed in the cavity. With the first terminal unit mounting block hole, the second terminal unit mounting block hole and the base panel hole being in registration with one another, the fastener structure extends therethrough from the base panel and projects outwardly from the opening.

31 Claims, 19 Drawing Sheets

ELECTRICAL CONNECTOR RECEPTACLE

FIELD OF THE INVENTION

The present invention relates to an electrical connector receptacle. More particularly, the present invention is directed to an electrical connector receptacle for use in vehicles.

BACKGROUND OF THE INVENTION

Electrical connector receptacles are known in the art. One such electrical connector receptacle is a cartridge fuse box as described in U.S. Pat. No. 5,618,209 to Lin et al. This cartridge fuse box includes a bottom shell, a cover shell, a holder frame, a plurality of terminal blocks, a fuse connector, a plurality of cartridge fuses and a plurality of clamps. The bottom shell is covered with the cover shell and includes the holder frame. The plurality of terminal blocks are mounted in respective horizontal holes on the holder frame to hold a respective conductor by a respective fastener and a respective metal socket by a respective screw for permitting the conductors to be connected to the metal sockets. The fuse connector is fixedly secured to the bottom shell remote from the holder frame in order to hold a plurality of metal sockets by a respective screw. The plurality of cartridge fuses is connected between the metal sockets of the fuse connector and the metal sockets of the terminal blocks. The plurality of clamps is respectively mounted in the holder frame to hold down the conductors of the terminal blocks.

There are several drawbacks regarding the prior art electrical connector receptacles such as the one described above. The prior art electrical connector receptacles are generally used for a low-voltage applications. Also, prior art electrical connector receptacles are often large and sometimes contain many components parts. Many prior art electrical connector receptacles are not shielded and therefore do not reduce the effects of electromagnetic interference. And, sometimes, there is no ground between an outer shield of the prior art electrical connector receptacle and a wire shield of the wiring connected to the prior art electrical connector receptacle.

It would be beneficial to provide an electrical connector receptacle that can be used for a low-voltage applications as well as high-voltage applications. It would also be advantageous to provide an electrical connector receptacle that is relatively small and contains relatively few components parts. It would also be beneficial to provide an electrical connector receptacle that is shielded in order to reduce the effects of electromagnetic interference. Furthermore, it would be advantageous to provide an electrical connector receptacle that can be grounded between its outer shield and the wire shield of the wiring connected to the electrical connector receptacle. The present invention provides these advantages and benefits.

OBJECTS AND SUMMARY OF THE INVENTION

It is an object of the invention to provide an electrical connector receptacle that can be used for a low-voltage applications as well as high-voltage applications.

It is another object of the invention to provide an electrical connector receptacle that is relatively small and contains relatively few components parts.

It is yet another object of the invention to provide an electrical connector receptacle this is shielded in order to reduce the effects of electromagnetic interference.

A still further object of the invention is to provide an electrical connector receptacle that can be grounded between its outer shield and the wire shield of the wiring connected to the electrical connector receptacle.

Accordingly, an electrical connector receptacle of the present invention is hereinafter described. An electrical connector receptacle includes a shield cover, a terminal unit and a fastener structure. The shield cover is fabricated from an electrically-conductive material and has a base panel, a first pair of opposing side walls connected to and depending from the base panel and a second pair of opposing side walls connected to and depending from the base panel and connected to the first pair of opposing side walls to define a cavity into the shield cover. The base panel has a base panel hole formed therethrough. The first and second pairs of opposing side walls are connected together to provide a peripheral side wall edge portion that forms an opening into the cavity.

The terminal unit has a first terminal unit mounting block, a second terminal unit mounting block, a first terminal assembly and a second terminal assembly. The first terminal unit mounting block is formed with a first terminal unit mounting block hole extending therethrough and the second terminal unit mounting block is formed with a second terminal unit mounting block hole extending therethough. The first and second terminal unit mounting blocks are releasably connected together in a stacked manner. The first terminal assembly and the second terminal assembly are mounted to the first terminal unit mounting block. And, the fastener structure has a fastener head and an elongated shaft.

With the first terminal unit mounting block hole and the second terminal unit mounting block hole being in registration with each other, the stacked, releasably-connected first and second terminal unit mounting blocks are disposed in the cavity and, with the first terminal unit mounting block hole, the second terminal unit mounting block hole and the base panel hole being in registration with one another, the fastener structure is operative in association with the shield cover and the terminal unit such that the fastener head is disposed exteriorly of the shield cover and facially opposes the base panel while the elongated shaft extends through the base panel hole, the first terminal unit mounting block hole and the second terminal unit mounting block hole and projects outwardly from the opening.

These objects and other advantages of the present invention will be better appreciated in view of the detailed description of the exemplary embodiments of the present invention with reference to the accompanying drawings, in which:

DETAILED DESCRIPTION OF THE EXEMPLARY EMBODIMENTS

Hereinafter, embodiments of the present invention will be described with reference to the attached drawings. The structural components common to those of the prior art and the structural components common to respective embodiments of the present invention will be represented by the same symbols and repeated description thereof will be omitted. Also, the present invention is described using terms such as "upper" and "lower" rather than using non-descriptive terms such as "first" and "second" for ease of reading and understanding the invention. These descriptive terms should not be construed as limiting the scope of the invention. One of ordinary skill in the art could easily substitute the non-descriptive terms for the chosen terms that are used for simplification purposes only.

Figure 1:
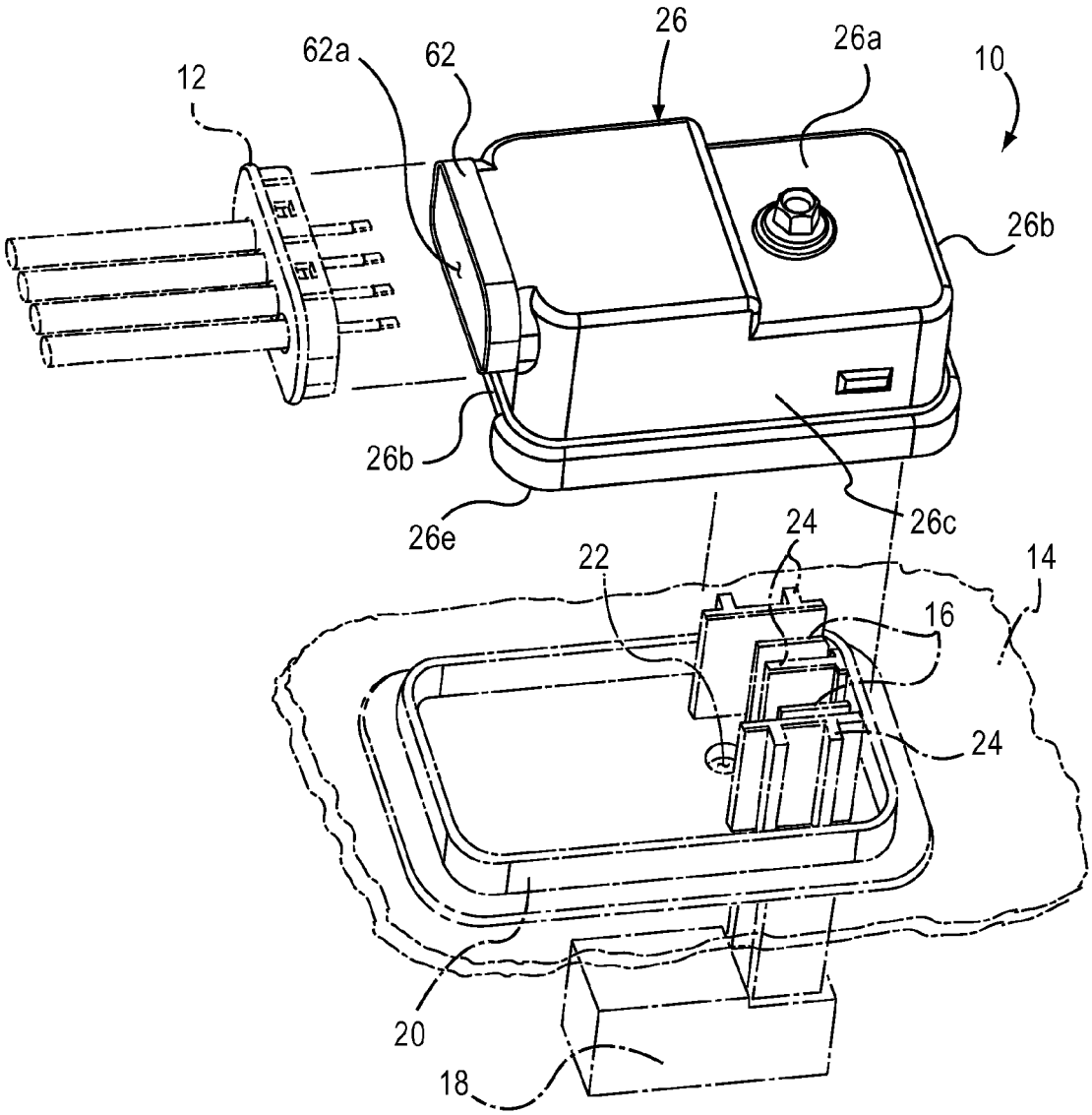
FIG. 1 is a top-down perspective view of one embodiment of an electrical connector receptacle of the present invention shown disposed above blade terminals of a power supply and disconnected, for illustration purposes only, from an assemblage of circuit wires.
Figure 2:
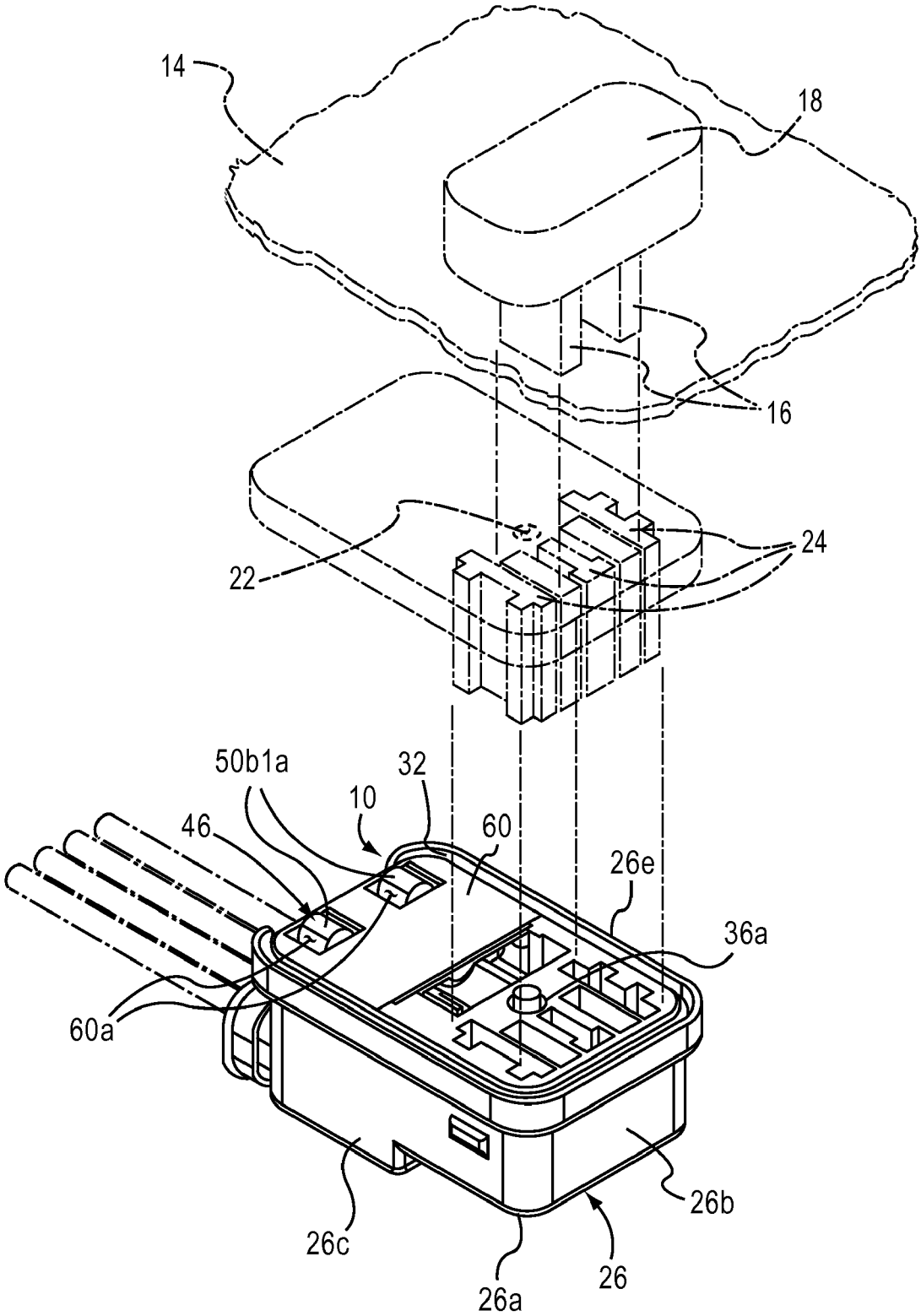
FIG. 2 is a bottom-up perspective view of the electrical connector receptacle shown in FIG. 1.
Figure 3:
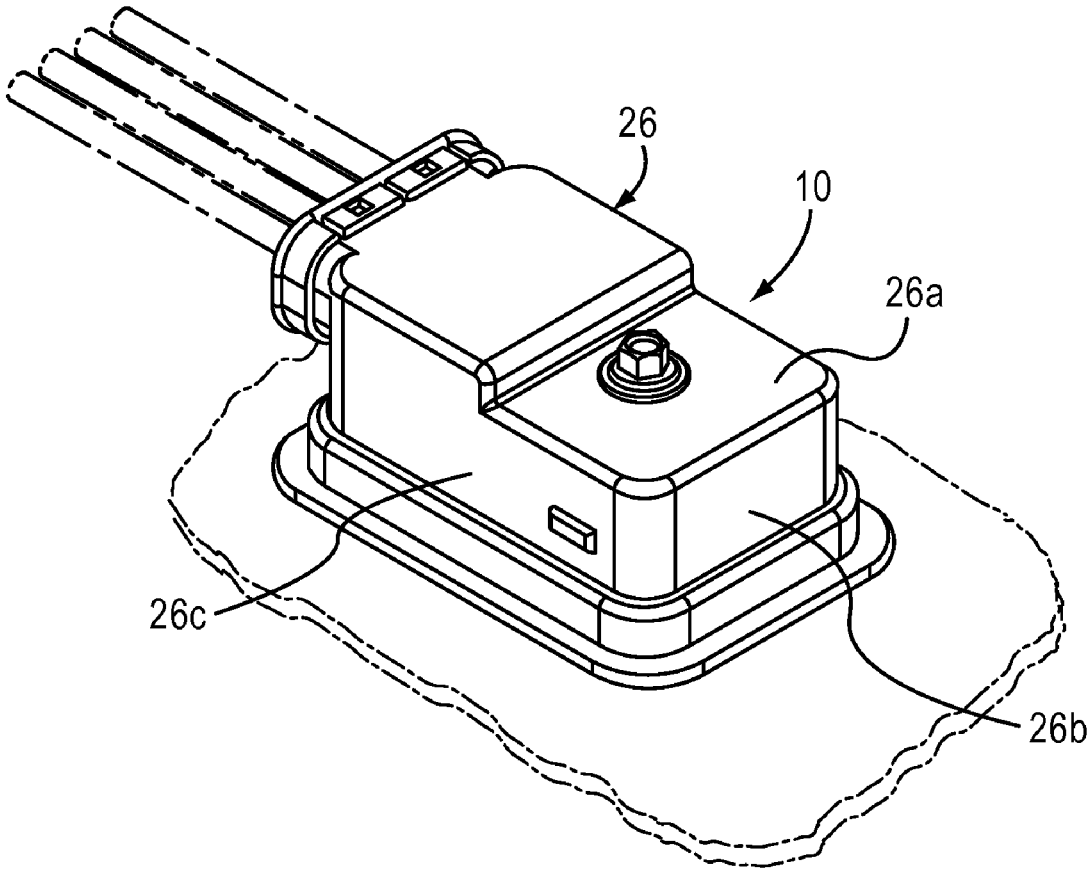
FIG. 3 is a top-down perspective view of the electrical connector receptacle shown in FIG. 1 electrically connected to the blade terminals of the power supply and connected to the assemblage of circuit wires.

A first exemplary embodiment of an electrical connector receptacle 10 of the present invention is hereinafter described with reference to FIGS. 1-14. As best shown in FIGS. 1-3, the electrical connector receptacle 10 is used in conjunction with a wiring assembly 12 and a support surface 14 having a pair of electrically-hot terminals 16 mounted thereto and electrically connected to a power source 18 such as a battery A barrier wall 20 surrounds the pair of electrically-hot terminals 16 as well as a fastening hole 22 and a key structure 24. The electrical connector receptacle 10 is adapted to connect to the power source 18 by receiving the electrically-hot terminals 16 and the key structure 24 and surround, at least in part, the barrier wall 20 as best shown in FIG. 3. The electrical connector receptacle 10 is then releasably connected to the support surface 14 via the fastening hole 22

Figure 5:
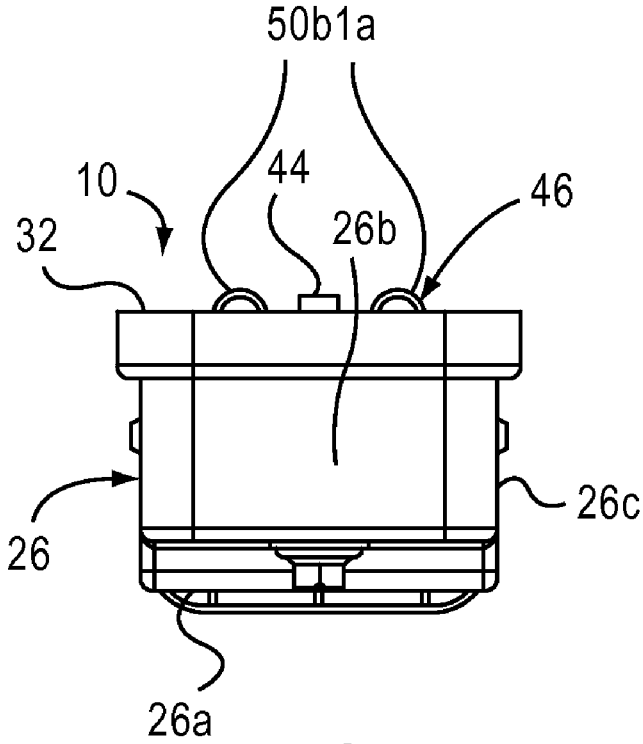
FIG. 5 is a front elevational view of the electrical connector receptacle shown in FIGS. 1 and 3.
Figure 6:
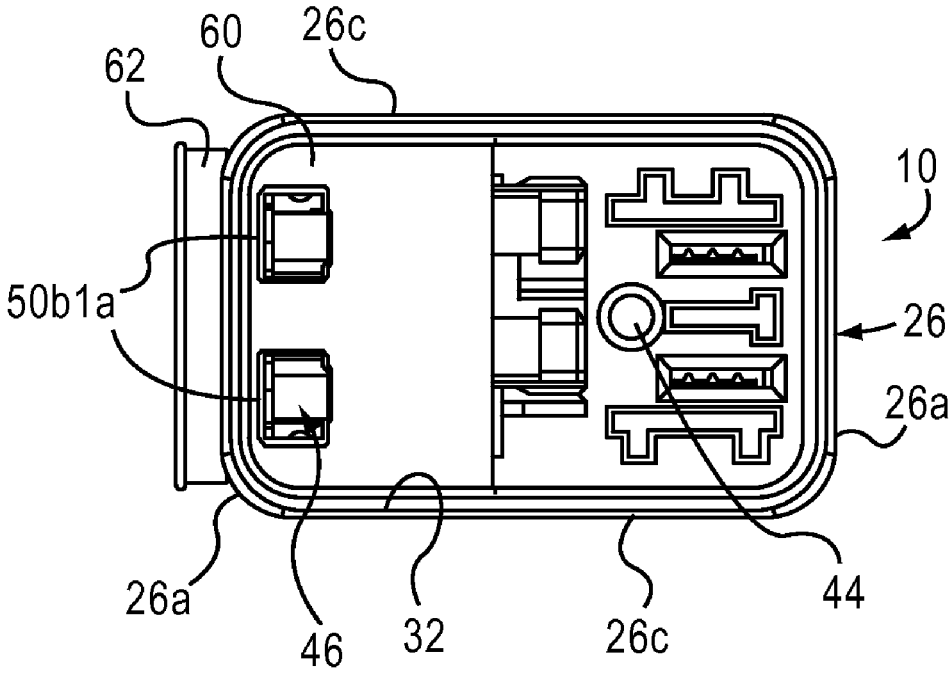
FIG. 6 is a bottom plan view of the electrical connector receptacle shown in FIGS. 1 and 3.
Figure 7:
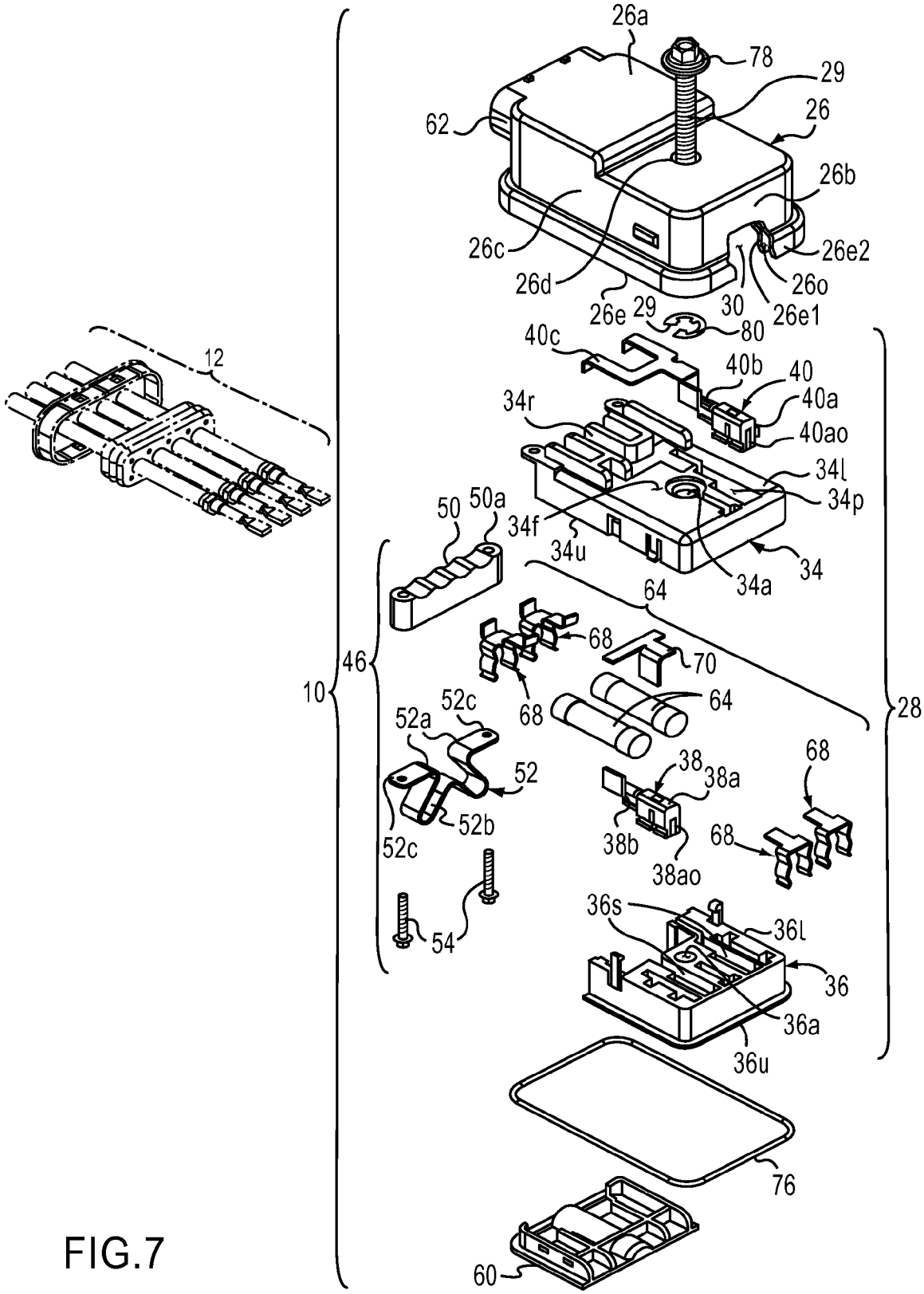
FIG. 7 is an exploded perspective view of the electrical connector receptacle.
Figure 8:
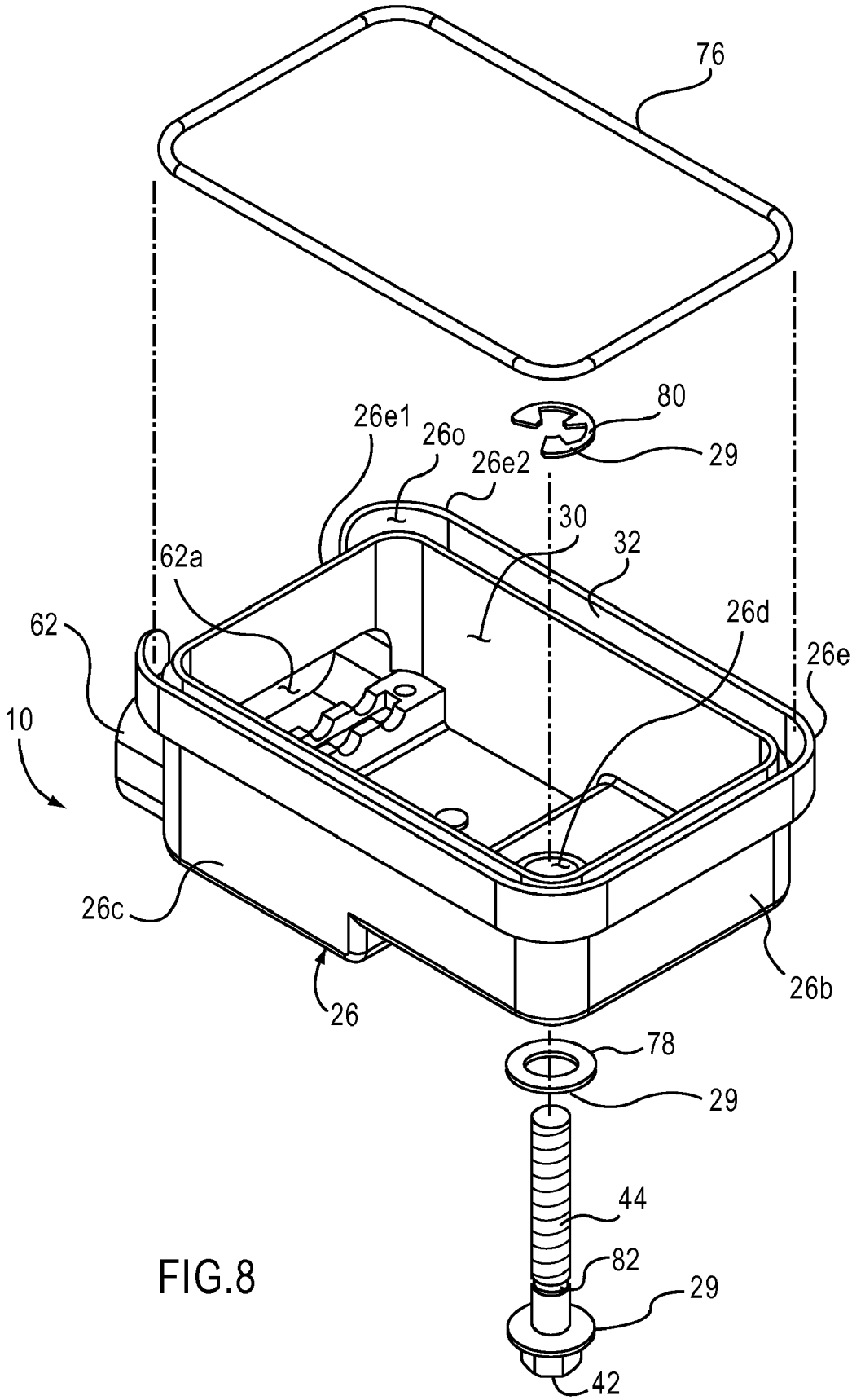
FIG. 8 is a partial perspective view of the electrical connector receptacle illustrating a shield cover, a fastening structure and a shield cover O-ring.

With reference to FIGS. 1-8, the electrical connector receptacle 10 includes a shield cover 26, a terminal unit 28 and a fastening structure 29. The shield cover 26 fabricated from an electrically-conductive material such as copper or aluminum and has a base panel 26*a*, a first pair of opposing side walls 26*b* connected to and depending from the base panel 26*a* and a second pair of opposing side walls 26*c* connected to and depending from the base panel 26*a* and connected to the first pair of opposing side walls 26*b* to define a cavity 30 formed into the shield cover 26. The base panel 26*a* has a base panel hole 26*d* that is formed through the base panel 26*a* as best shown in FIGS. 7 and 8. A skilled artisan would appreciate that the first pair of side walls 26*b* and the second pair of side walls 26*c* are connected together to provide a peripheral side wall edge portion 26*e*. The peripheral side wall edge portion 26*e* forms an opening 32 into the cavity 30.

Figure 11:
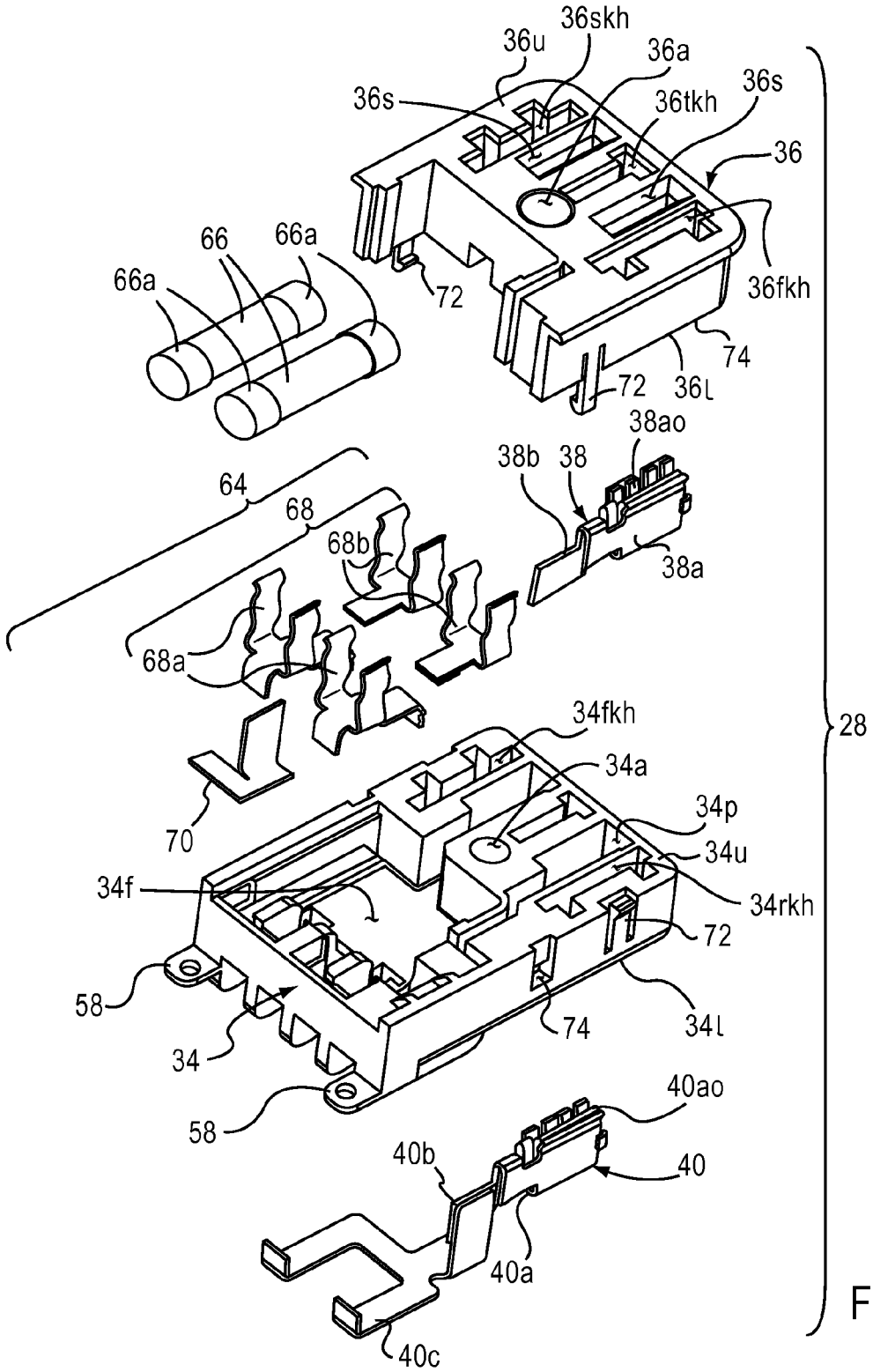
FIG. 11 is an exploded perspective view of a terminal unit of the electrical connector receptacle.

In FIGS. 7 and 11, the terminal unit 28 has a first terminal unit mounting block 34, a second terminal unit mounting block 36, a first terminal assembly 38 and a second terminal assembly 40. The first terminal unit mounting block 34 is formed with a first terminal unit mounting block hole 34*a* that extends through the first terminal unit mounting block 34. The second terminal unit mounting block 36 is formed with a second terminal unit mounting block hole 36*a* that extends though the second terminal unit mounting block 36. The first and second terminal unit mounting blocks 34 and 36 respectively are releasably connected together in a stacked manner as that shown in FIGS. 7 and 11. The first terminal assembly 38 and the second terminal assembly 40 are mounted to the first terminal unit mounting block 38. As shown in FIG. 8, the fastener structure 29 is a bolt that has a fastener head 42 and an elongated shaft 44.

Figure 4:
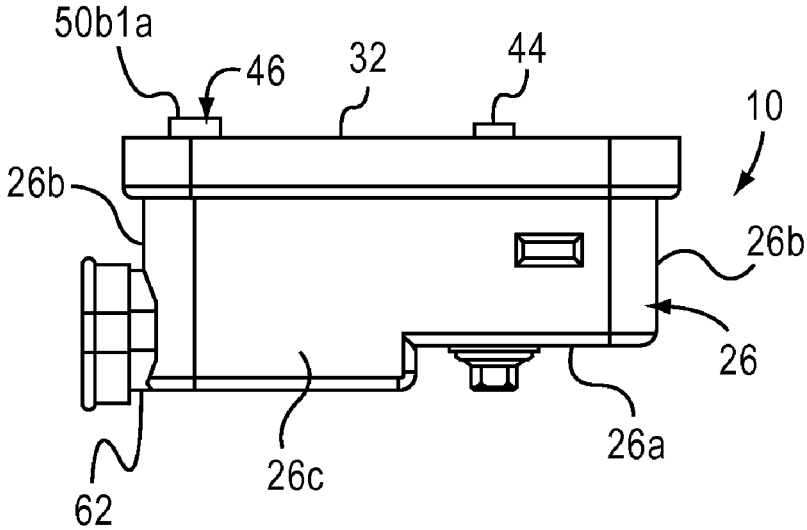
FIG. 4 is a side elevation view of the electrical connector receptacle shown in FIGS. 1 and 3.

With reference to FIGS. 7 and 12-14, the first terminal unit mounting block hole 34*a* and the second terminal unit mounting block hole 36 are in registration with each other and the stacked, releasably-connected first and second terminal unit mounting blocks 34 and 36 are disposed in the cavity 30. And, with the first terminal unit mounting block hole 34*a*, the second terminal unit mounting block hole 36*a* and the base panel hole 26*a* being in registration with one another, the fastener structure 29 is operative in association with the shield cover 26 and the terminal unit 28 such that the fastener head 42 is disposed exteriorly of the shield cover 26 and facially opposes the base panel 26*a* while the elongated shaft 44 extends through the base panel hole 26*d*, the first terminal unit mounting block hole 34*a* and the second terminal unit mounting block hole 36. As shown in FIGS. 4-6, the elongated shaft 44 projects outwardly from the opening 32.

As best shown in FIGS. 7 and 9-14, the electrical connector receptacle 10 also includes a grounding assembly 46. The grounding assembly 46 is sized to be received and releasably retained in the cavity 30. The grounding assembly 46 has a resiliently-biased grounding element 48 that projects outwardly from the opening 32 when the grounding assembly 46 is received and releasably retained in the cavity 30 as particularly shown in FIGS. 4 and 5. The grounding assembly 46 includes a ground bar member 50, a yoke member 52 and a pair of grounding assembly fasteners 54. For the first exemplary embodiment of the electrical connector receptacle 10 of the present invention, the ground bar member 50 is fabricated from an electrically-conductive material such as copper, aluminum or other electrically-conductive metal known in the art. The yoke member 52 fabricated from an electrically-conductive sheet material such as copper, aluminum or other electrically-conductive sheet metal known in the art and is bent in a manner such that the yoke member is resiliently-biased. The pair of grounding assembly fasteners 54 are conventional bolts.

In FIGS. 9-13, the grounding bar member 50 has a pair of grounding bar member holes 50*a* that extend through the grounding bar member 50. As that shown in FIG. 13, the yoke member 52 has a pair of leg portions 52*a* and a contact portion 52*b* that interconnects the pair of leg portions 52*a*. Each leg portion 52*a* has a leg portion hole 52*c* formed therethrough. Further, the contact portion 52*b* includes a pair of outwardly-projecting U-shaped sections 52*b*1 and an inwardly-projecting U-shaped section 52*b*2. The pair of outwardly-projecting U-shaped sections 52*b*1 are interconnected by the inwardly-projecting U-shaped section 52*b*2. Respective ones of the pair of leg portions 52*a* are connected to respective ones of the outwardly-projecting U-shaped sections 52*b*1 to form a generally Omega-shaped configuration.

Figure 9:
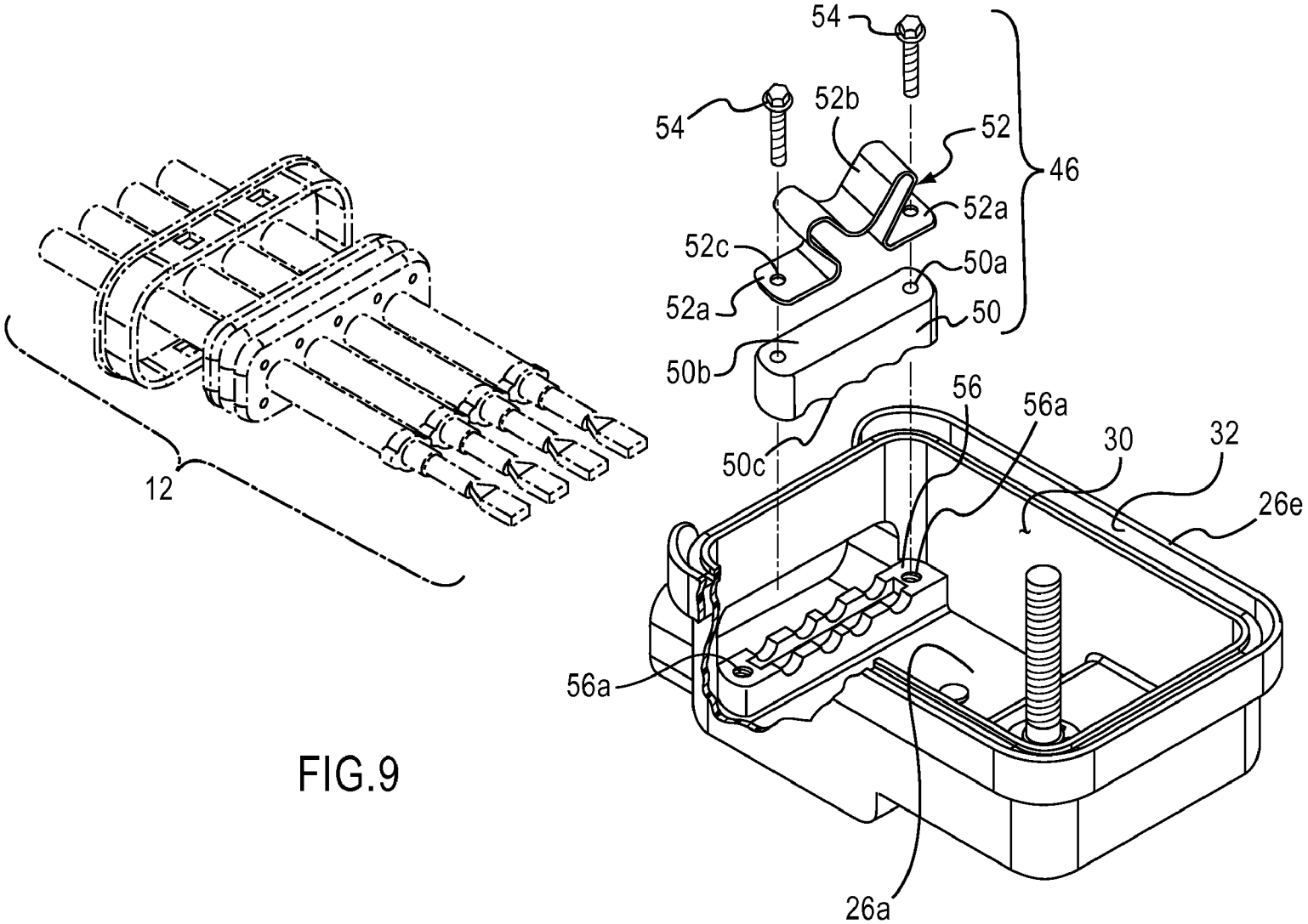
FIG. 9 is a partial perspective view of the electrical connector receptacle illustrating the shield cover and a fastening structure connected to the shield cover with the assemblage of circuit wires disconnected therefrom and a grounding assembly exploded from the shield cover.
Figure 10:
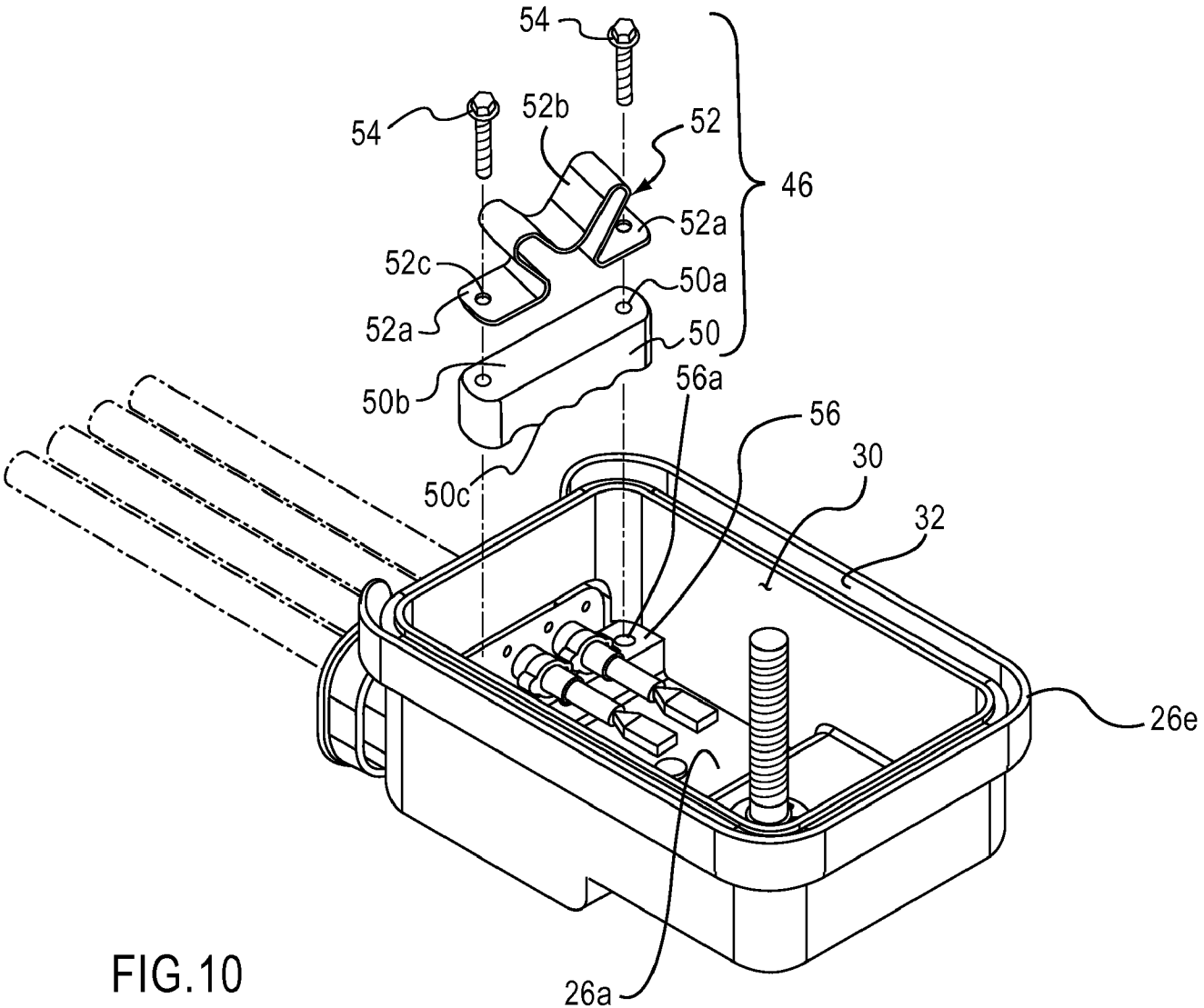
FIG. 10 is a partial perspective view of the electrical connector receptacle illustrating the shield cover and a fastening structure connected to the shield cover with the assemblage of circuit wires disposed in a cavity of the shield cover and the grounding assembly exploded from the shield cover.

As shown in FIGS. 9 and 10, the electrical connector receptacle 10 also includes a grounding assembly mounting block 56. The grounding assembly mounting block 56 is disposed in the cavity 30 and is integrally connected to the base panel 26*a* of the shield cover 26. In FIG. 9, the grounding assembly mounting block 56 has a pair of threaded grounding assembly mounting block holes 56*a* that are disposed apart from one another. Particularly with reference to FIGS. 13 and 14, the grounding assembly mounting block 56 and the grounding bar member 50 are associated with one another in a manner that respective ones of the pair of grounding bar member holes 50*a*, the pair of threaded grounding assembly mounting block holes 56*a* and the leg portion holes 52*c* register with one another in order to receive the respective ones of the grounding assembly fasteners 54 for releasably connecting the grounding assembly 46 and the shield cover 26 to each other.

As best shown in FIG. 11, the first terminal unit mounting block 34 includes a pair of eyelets 58. The pair of eyelets 58 are disposed apart from one another and integrally formed with and project from the first terminal unit mounting block 34. As best reflected in FIG. 13, respective ones of the pair of eyelets 58 register with respective ones of the pair of grounding bar member holes 50*a*, the pair of threaded grounding assembly mounting block holes 56*a* and the leg portion holes 52*c* register with one another to receive respective ones of the grounding assembly fasteners 54 for releasably connecting the grounding assembly 46, the first terminal unit mounting block 34 and the shield cover 26 to each other. The pair of eyelets 58 are disposed between the grounding bar member 50 and the grounding assembly mounting block 56.

Figure 14:
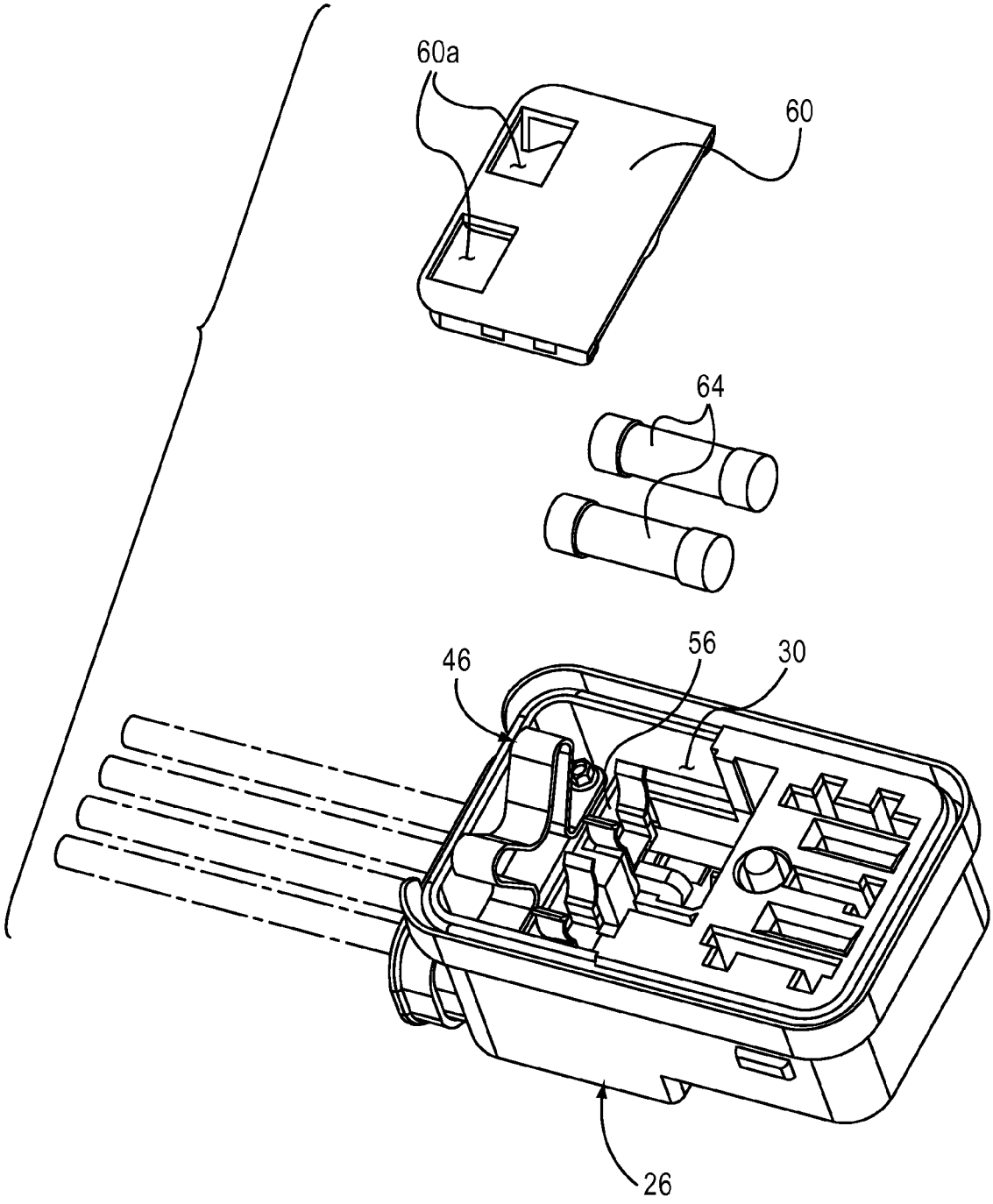
FIG. 14 is a bottom-up perspective view of the electrical connector receptacle with the terminal unit, the fuse assembly and the grounding assembly disposed in the cavity formed by the shield cover with a pair of fuses and grounding assembly panel cover exploded therefrom.

As reflected in FIG. 14, when the grounding assembly 46 and the shield cover 26 are releasably connected to each other, at least portions of the outwardly-projecting U-shaped sections 50*b*1*a* project outwardly from the opening (FIGS. 2, 4 and 5) while the inwardly-projecting U-shaped section 50*b*2 and the pair of leg portions 52*a* are disposed interiorly of the cavity 30 (as reflected in FIG. 14).

As shown in FIGS. 2, 6 and 7, the electrical connector receptacle 10 includes a grounding assembly panel cover 60. The grounding assembly panel cover 60 is releasably connected to the shield cover 26 within the cavity 30 as is commonly known in the art. The grounding assembly panel cover 60 has a pair of grounding assembly panel cover holes 60*a* that are formed therethrough in order to permit the portions 50*b*1*a* of the outwardly-projecting U-shaped sections 50*b*1 to project outwardly from the opening 32 as that shown in FIGS. 4-6. Simultaneously therewith, the grounding assembly panel cover 60 covers the inwardly-projecting U-shaped section 52*b*2 and the pair of leg portions 52*c*.

Figure 12:
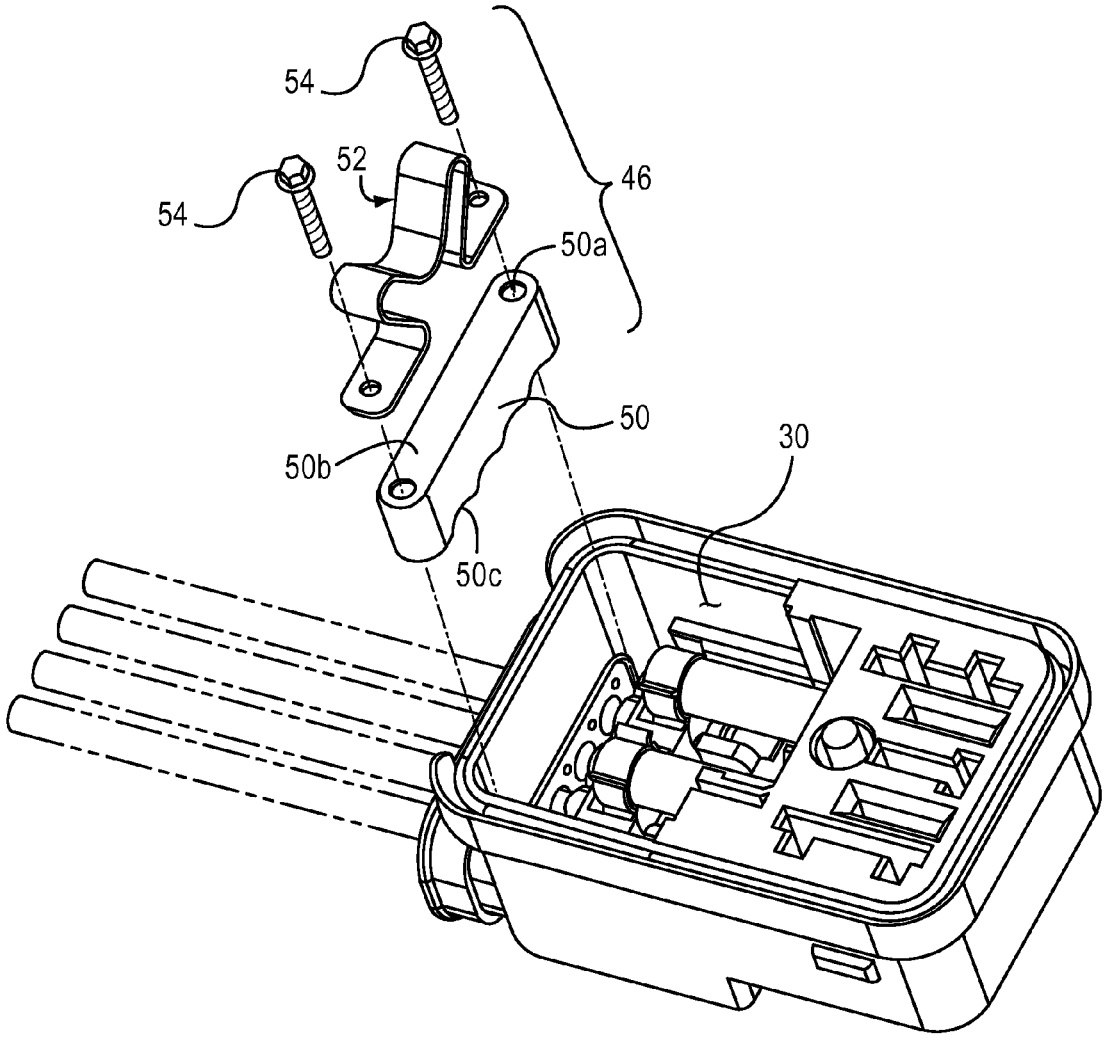
FIG. 12 is a bottom-up perspective view of the electrical connector receptacle with the terminal unit and a fuse assembly disposed in a cavity formed by the shield cover with the grounding assembly exploded from the shield cover.
Figure 13:
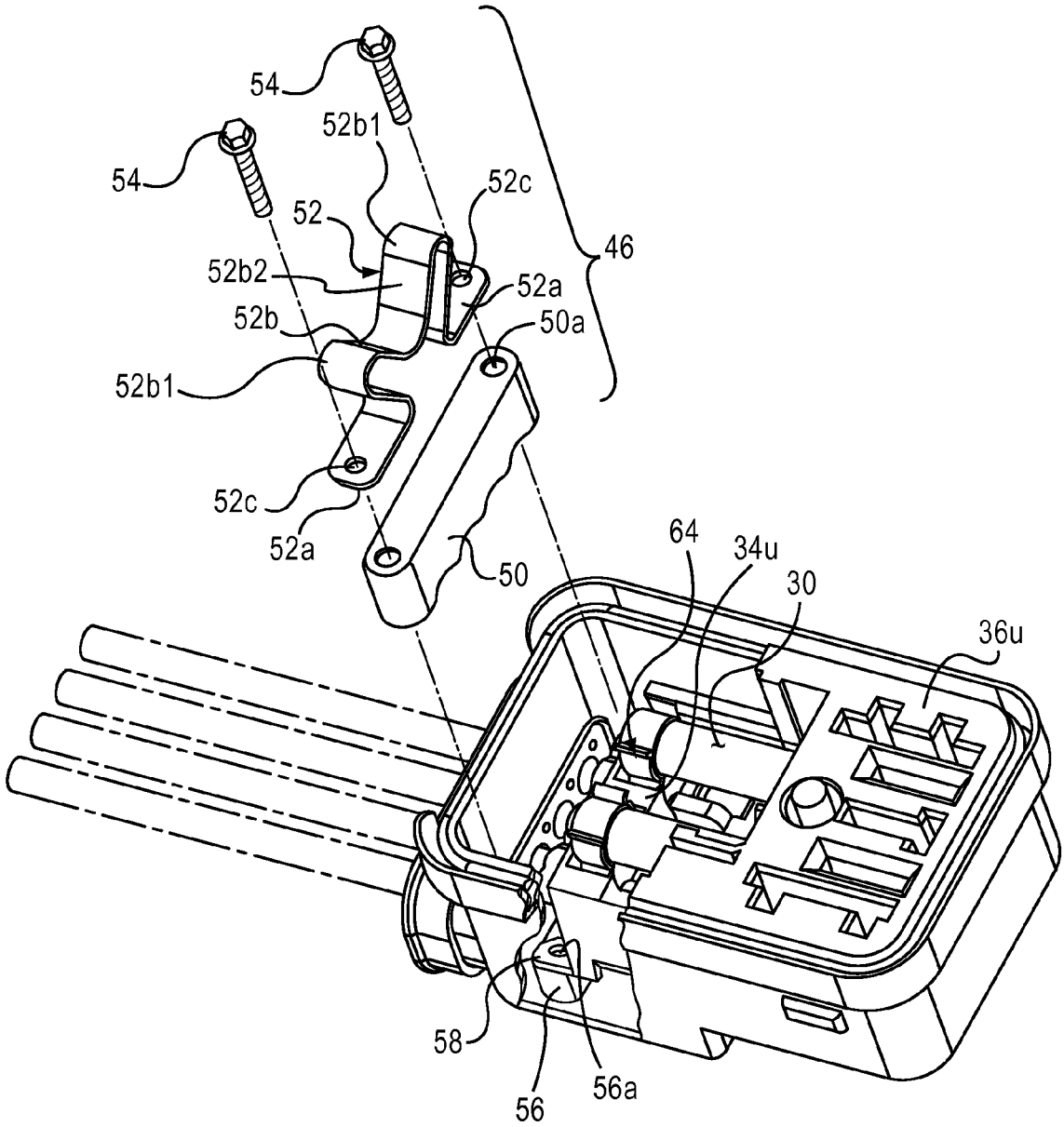
FIG. 13 is an enlarged bottom-up perspective view, partially broken away, of the electrical connector receptacle with the terminal unit and the fuse assembly disposed in the cavity formed by the shield cover with the grounding assembly exploded from the shield cover.

By way of example only and not by way of limitation, the grounding assembly mounting block 56 is disposed adjacent a selected one of the first pair of sidewalls 26*b* or the second pair of side walls 26*c* as that shown in FIG. 13. In FIGS. 1, 4, 6 and 7, the shield cover 26 includes a shield cover conduit 62. The shield cover conduit 62 defines a shield cover passageway 62*a* (FIG. 1) that extends through the shield cover conduit 62. The shield cover conduit 62 is integrally connected to a selected one of the first pair of sidewalls 26*b* and second pair of side walls 26*c*. Note that the shield cover passageway 62*a* is in communication with the cavity 30 as shown in FIG. 8. In FIGS. 9, 10 and 12, the ground bar member 50 has a flat surface 50*b* and an opposite scalloped surface 50*c*. The pair of grounding bar member holes 50*a* extend through and between the flat surface 50*b* and the scalloped surface 50*c*.

In FIGS. 7 and 11, the first terminal assembly 38 includes a first terminal member 38*a* and a first terminal member connector extension 38*b* that is electrically connected to the first terminal member 38*a*. Also, a fuse assembly 64 is disposed in the cavity 30 as that shown in FIG. 13. The fuse assembly 64 is connected to the first terminal unit mounting block 34 and includes a pair of fuses 66, two pairs of fuse holders 68*a* and 68*b* and a fuse clip bus bar 70. As best shown in FIGS. 7 and 11, each fuse holder 68 has a live-side fuse clip 68*a* and a dead-sided fuse clip 68*b*. For each fuse holder 68, the live-side fuse clip 68*a* and the dead-side fuse clip 68*b* are disposed apart from one another at a distance sufficient to receive opposing electrically-conductive fuse end portions 66*a* of one fuse 66 as illustrated in FIG. 11. The fuse clip bus bar 70 electrically interconnects the live-side fuse clips 68*a* and the first terminal member connector extension 38*b*.

In FIGS. 7 and 11, the first terminal unit mounting block 34 has a first terminal unit upper mounting surface 34*u* and an opposite first terminal unit lower mounting surface 34*s*. The first terminal unit upper mounting surface 34*u* has a fuse assembly recess 34*f* formed thereinto. The fuse assembly recess 34*f* is sized to matably receive and retain the pair of fuse holders 68 therein. The second terminal assembly 40 includes a second terminal member 40*a*, a second terminal member connector extension 40*b* that is electrically connected to the second terminal member 40*a* and a second terminal assembly bus bar 40*c* that is electrically connected to the second terminal member connector extension 40*b*.

Again, with reference to FIGS. 7 and 11 the first terminal unit mounting block 34 has a terminal member passageway 34*p* that extends through and between the first terminal unit upper mounting surface 34*u* and the first terminal unit lower mounting surface 34*l*. The first terminal unit lower mounting surface 34*l* has a second terminal assembly bus bar recess 34*r* that is formed into the first terminal unit lower mounting surface 34*l*. The second terminal assembly bus bar recess 34*r* sized to matably receive and retain the second terminal assembly bus bar 40*c* therein. The terminal member passageway 34*p* is sized to slidably receive the second terminal member 40*a* from the first terminal unit lower mounting surface 34*l*. By way of example only and not by way of limitation, each one of the first and second terminal members 38*a* and 40*a* respectively is a female blade-receiving terminal having a female-blade receiving opening 38*ao* and 40*ao* respectively.

With reference to FIGS. 7 and 11, the second terminal unit mounting block 36 has a second terminal unit upper mounting surface 36*u* and an opposite second terminal unit lower mounting surface 36*l*. The second terminal unit mounting block 36 includes a pair of terminal slots 36*s* that are disposed apart from one another and extend to and between the second terminal unit upper mounting surface 36*u* and the second terminal unit lower mounting surface 36*l*. Respective ones of the female-blade receiving openings 38*ao* and 40*ao* are in registration and communication with respective ones the pair of terminal slots 36*s*.

In FIG. 11, the second terminal unit mounting block 36 has a first key hole 36*fky* and a second key hole 36*skh*. The second keyhole 36*skh* is configured differently from the first key hole 36*fkh*. The first and second key holes 36*fkh* and 36*sky* respectively extend to and between the second terminal unit upper mounting surface 36*u* and the second terminal unit lower mounting surface 36*l*. Also, the second terminal unit mounting block 36 has a third key hole 36*tkh* that extends to and between the second terminal unit upper mounting surface 36*u* and the second terminal unit lower mounting surface 36*l*. The third key hole 36*tky* is configured differently from the first key hole 36*fkh* and second key hole 36*skh*. The third key hole 36*tky* is disposed between the pair of terminal slots 36*s* and the third key hole 36*tkh* and the pair of terminal slots 36*s* are disposed between the first key hole 36*fkh* and the second key hole 36*skh*.

Again, in FIG. 11, the first terminal unit mounting block 34 has a fourth key hole 34*rkh* and a fifth key hole 34*fkh* that is configured differently from the fourth key hole 34*rkh*. The fourth key hole 34*rkh* and the fifth key hole 34*fkh* extend to and between the first terminal unit upper mounting surface 34*u* and the first terminal unit lower mounting surface 34*l*. The fourth key hole 34*rkh* is configured identically to and aligns in registration with the first key hole 36*fkh* and the fifth key hole 34*fkh* is configured identically to and aligns in registration with the second key hole 36*skh*. Furthermore, the first terminal unit mounting block 34 has a sixth key hole 34*skh* that extends to and between the first terminal unit upper mounting surface 34*u* and the first terminal unit lower mounting surface 34*l*. The sixth key hole 34*skh* is configured differently from the fourth key hole 34*rkh* and the fifth key hole 34*fkh*. The sixth key hole 34*skh* is disposed between the fourth key hole 34*rkh* and the fifth key hole 34*fkh*. The sixth key hole 34*skh* is configured identically to and aligns in registration with the third key hole 36*tkh*.

By way of example only and not by way of limitation, the first terminal unit mounting block 34 and the second terminal unit mounting block 36 include a pair of latch elements 72. However, one of ordinary skill in the art would appreciate that at least one of the first terminal unit mounting block 34 or the second terminal unit mounting block 36 includes a pair of latch elements 72. Again, by way of example only and not by way of limitation, the first terminal unit mounting block 34 and the second terminal unit mounting block 36 include a pair of latch receiving holes 74 (only one of each pair being shown in FIG. 11) that are sized and adapted to release ably receive the respective ones of the pair of latch elements 72. Again, however, one of ordinary skill in the art would appreciate that at least a remaining one of the first terminal unit mounting block 34 and a second terminal unit mounting block 36 includes a pair of latch receiving holes 74 that are sized and adapted to releasably receive respective ones of the pair of latch elements 72 in order to releasably connect the first terminal unit mounting block 34 and the second terminal unit mounting block 36 together. When the first terminal unit mounting block 34 and the second terminal unit mounting block 36 are releasably connected together, the first terminal unit upper mounting surface 34*u* and the second terminal unit lower mounting surface 36*l* are in facial contact with each other. With this orientation, the first terminal unit upper mounting surface 34*u* and the second terminal unit upper mounting surface 36*u* are disposed in the cavity 30 and face the opening 32 as that shown in FIG. 13.

As illustrated in FIGS. 7 and 8, the peripheral side wall edge portion 26*e* of the shield cover 26 includes an inner peripheral side wall 26*e*1 that extends circumferentially about the shield cover 26 and an outer peripheral side wall 26*e*2 that is connected to and is disposed apart and outwardly from the inner peripheral side wall 26*e*1 to define a shield cover O-ring receiving channel 26*o* therebetween. By example only for the exemplary embodiment of the electrical connector receptacle 10, the outer peripheral side wall 26*e*2 extends along at least the second first pair of side walls 26*c* and one of the pair of first side walls 26*b*. However, the outer peripheral side wall 26*e*2 extends partially along a remaining one of the pair of first side walls 26*b*. More specifically, the outer peripheral side wall 26*e*2 essentially extends around the opposing corners and only partially along the remaining one of the pair of first side walls 26*b* as best illustrated in FIG. 8. Again, with reference to FIG. 8, a shield cover O-ring 76 is sized and adapted to be received by the O-ring receiving channel 26*o*.

With reference to FIGS. 7 and 8, the fastener structure 29 includes a fastener O-ring 78 and a fastener retainer clip 80. A skilled artisan would appreciate that the fastener structure 29 might include more than one fastener O-ring 78. The elongated shaft has a groove 82 formed circumferentially thereabout. The fastener O-ring 78 is disposed in the groove 82 and surrounds the elongated shaft 44 adjacent the fastener head 42. The fastener retainer clip 80 is connected to the elongated shaft 44 adjacent the fastener O-ring 78. The fastener O-ring 78 is disposed between the fastener head 42 and the fastener retainer clip 80, particularly, when the fastener structure 29 is operative in association with the shield cover 26 and the terminal unit 28. The fastener O-ring 78 is disposed exteriorly of the shield cover 26 and the fastener retainer clip 80 is disposed in the cavity 30 between the shield cover 26 and the terminal unit 28.

Figure 15:
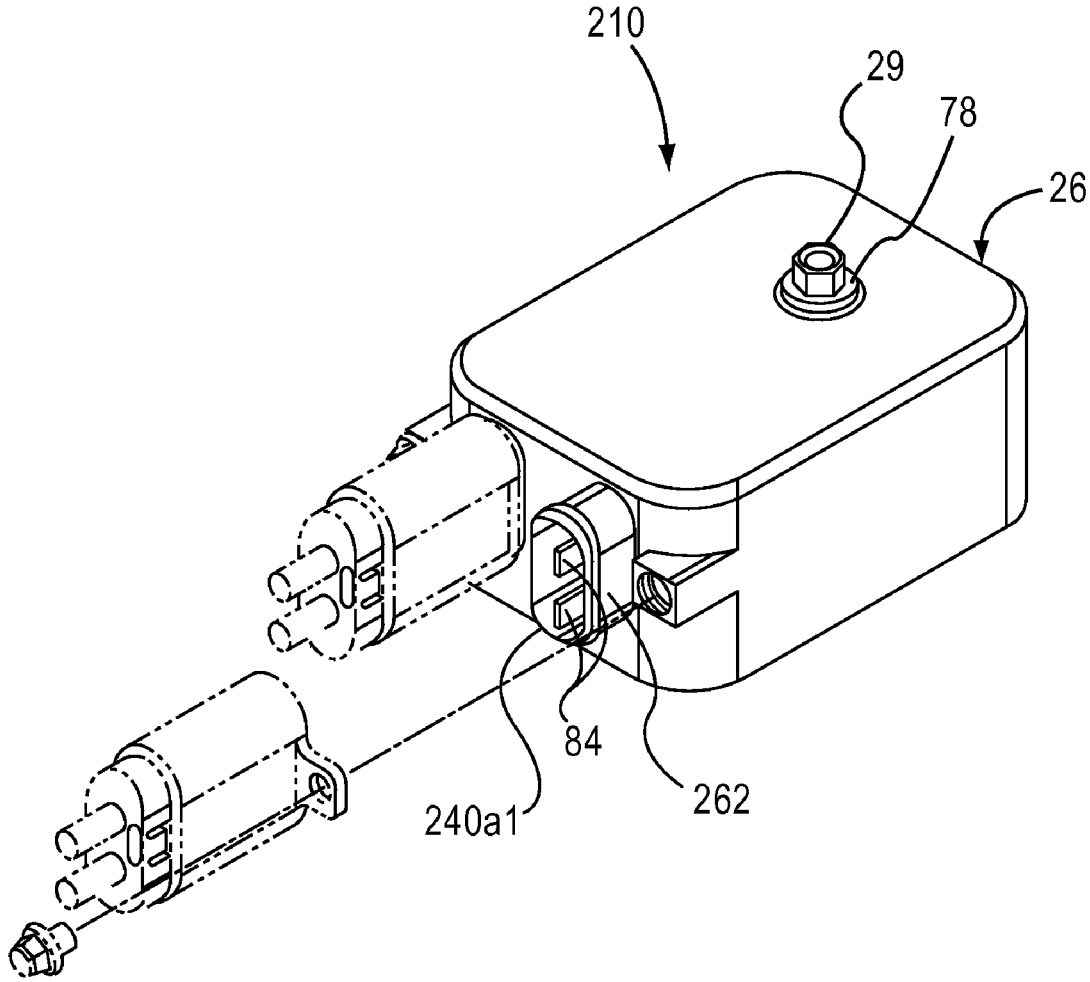
FIG. 15 is a perspective view of another exemplary embodiment of the electrical connector receptacle of the present invention.
Figure 16:
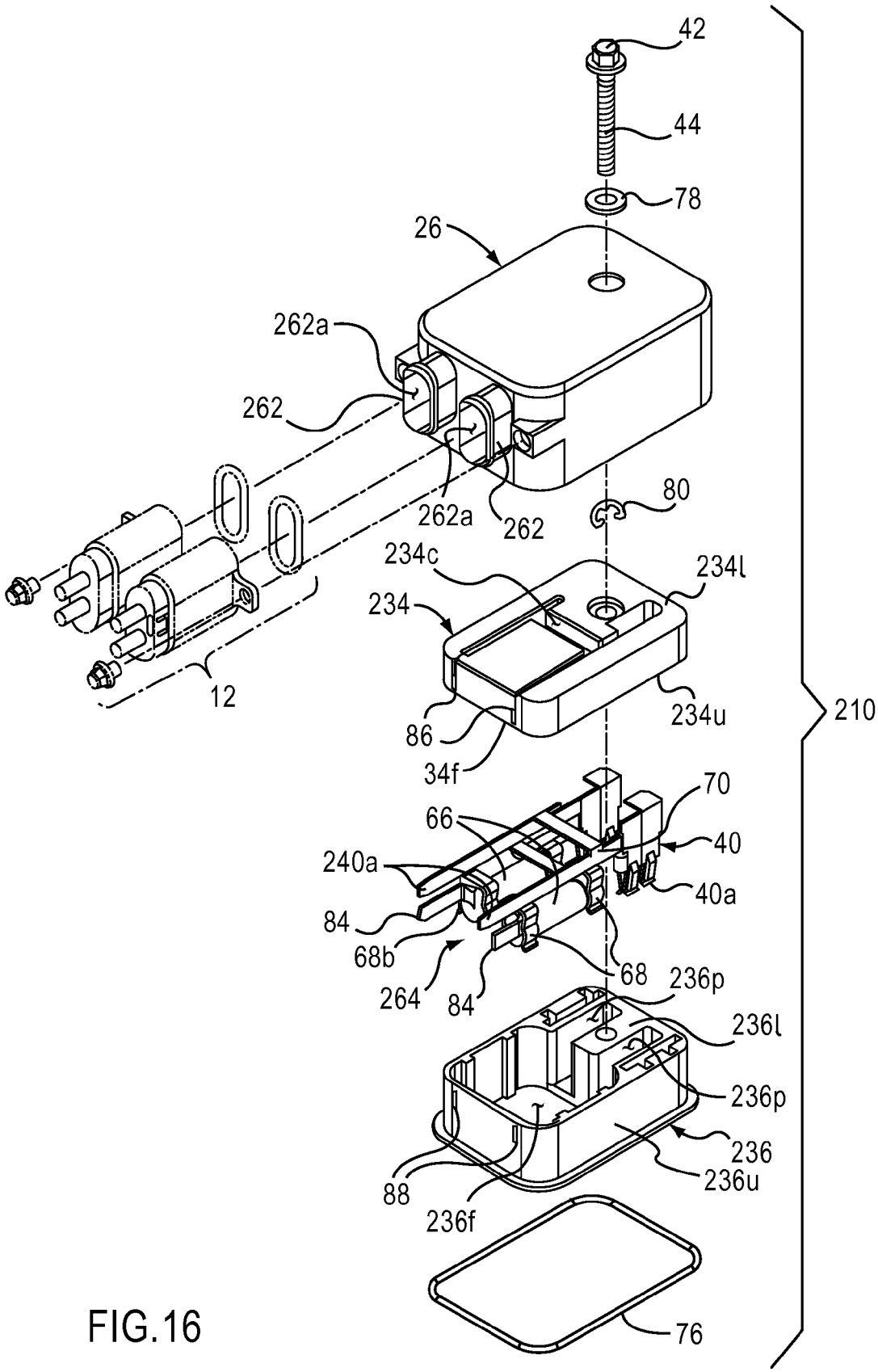
FIG. 16 is an exploded perspective view of the electrical connector receptacle shown in FIG. 15.
Figure 17:
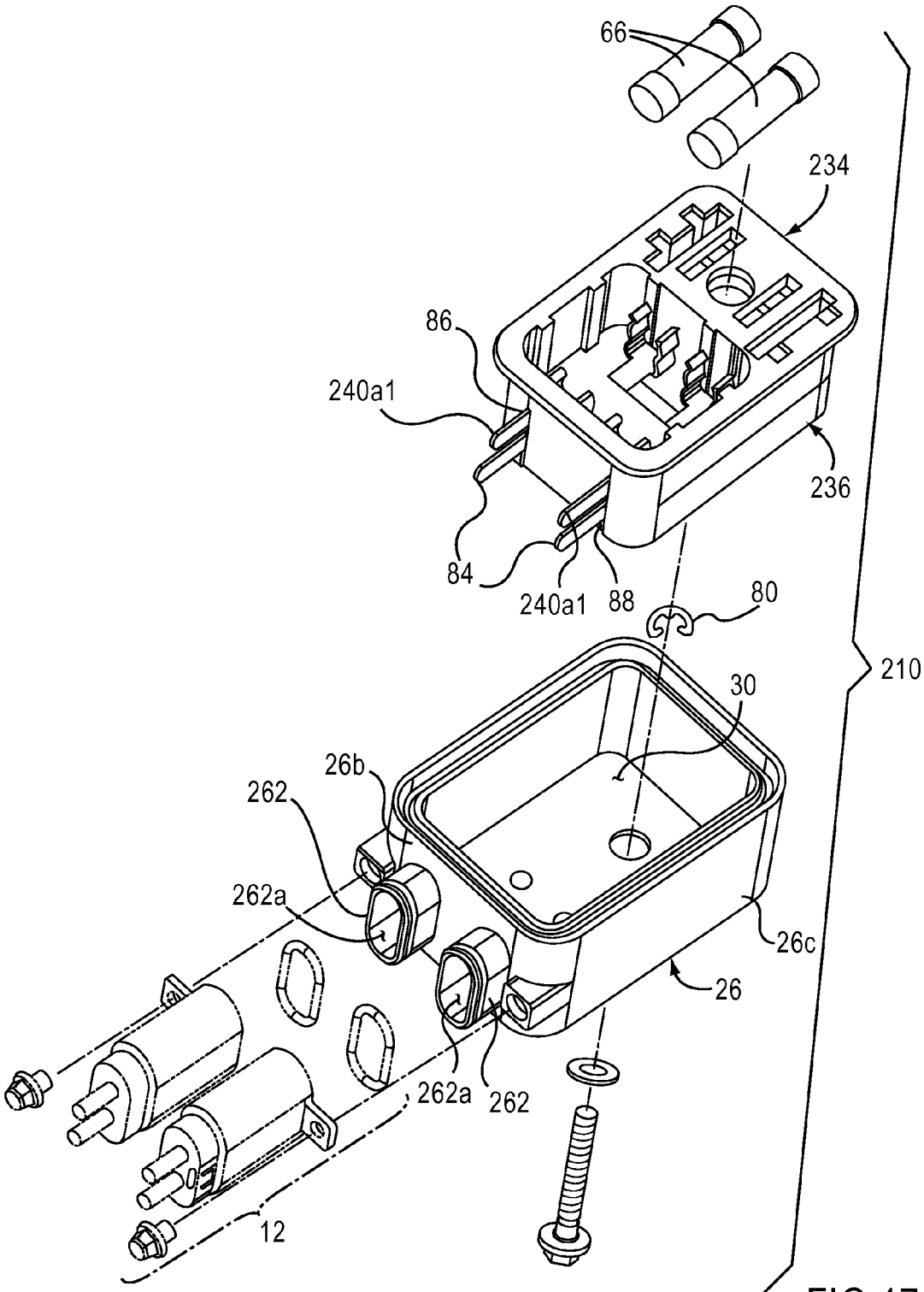
FIG. 17 is a bottom-up exploded perspective view of the electrical connector receptacle shown in FIG. 15.
Figure 18:
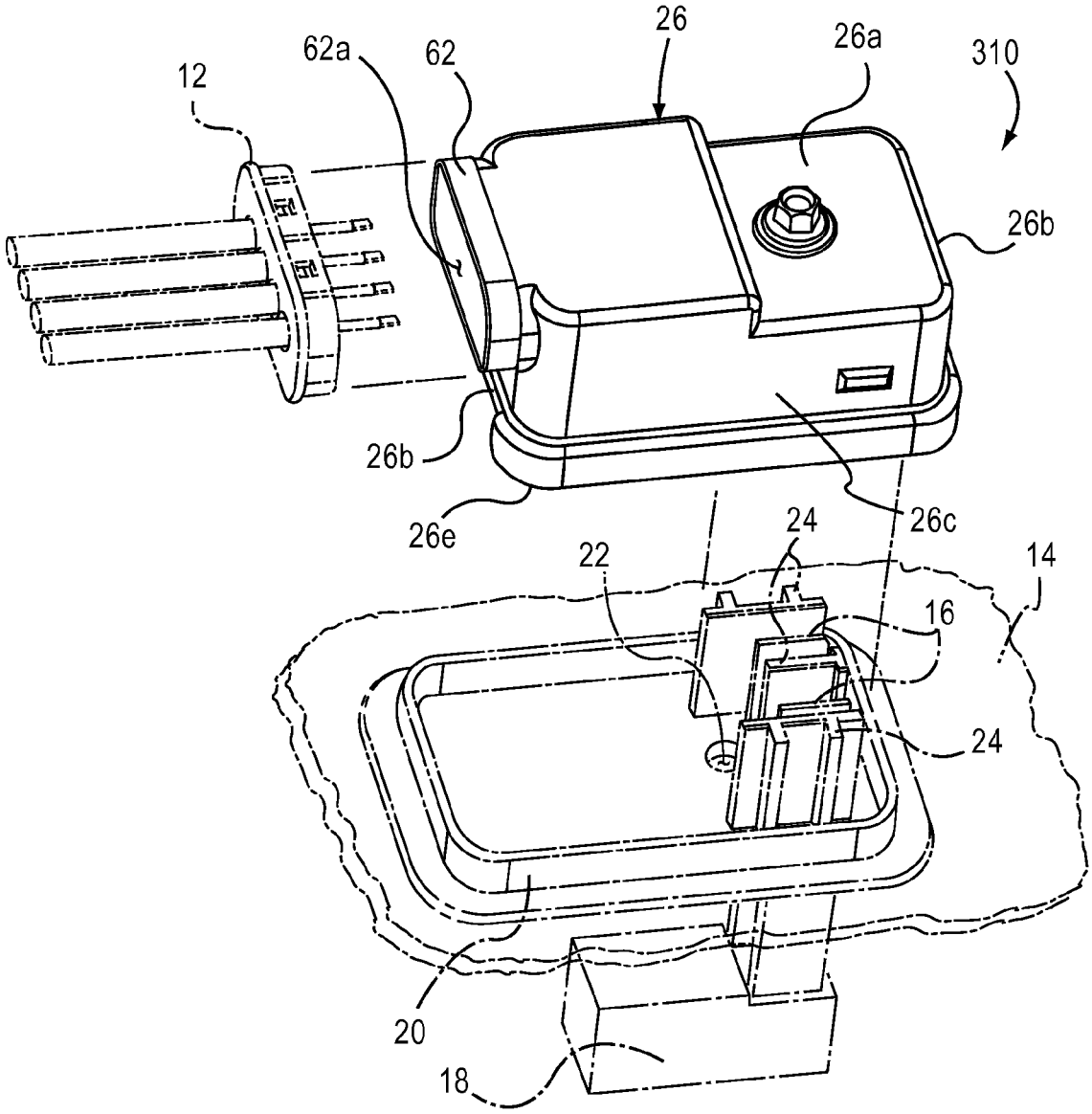
FIG. 18 is a top-down perspective view of yet another embodiment of an electrical connector receptacle of the present invention shown disposed above blade terminals of the power supply and disconnected, for illustration purposes only, from the assemblage of circuit wires.

Another exemplary embodiment of an electrical connector receptacle 210 of the present invention is introduced in FIGS. 15-17. The electrical connector receptacle 210 is similar to the electrical connector receptacle 10 discussed above except for the differences discussed hereinbelow.

In FIG. 16, a fuse assembly 264 is connected to a first terminal unit mounting block 234 and includes the pair of fuses 66, the pair of fuse holders 68 and a fuse clip bus bar 70. Each dead-side fuse clip 68*b* has a fuse clip terminal 84 extending from the dead-side fuse clip 68*b*. The first terminal unit mounting block 234 has a first terminal unit upper mounting surface 234*u* and an opposite first terminal unit lower mounting surface 234*l*. The first terminal unit upper mounting surface 234*u* has terminal receiving cavity 234*c* that is formed thereinto. A pair of terminal slots 86 are disposed between the first terminal unit upper mounting surface 234*u* and the first terminal unit lower mounting surface 234*l* and are in communication with the terminal receiving cavity 234*c*. The fuse assembly recess 34*f* is sized to matably receive and retain the pair of fuse holders 68 therein. The second terminal assembly 40 includes the second terminal member 40*a* and a pair of elongated second terminal assembly bus bars 240*a* electrically connected to the second terminal member 40*a* and extending parallel to the fuse clip terminals 84. Respective ones of the pair of second terminal assembly bus bars 240*a* are received in respective ones of the pair of terminal slots 86. Note that distal second terminal assembly bus bar ends 240*a*1 project from the first terminal unit mounting block 234 as shown in FIG. 17.

Again, in FIG. 16, a second terminal unit mounting block 236 has a second terminal unit upper mounting surface 236*u* and an opposite second terminal unit lower mounting surface 236*l*, a pair of terminal receiving passageways 236*p* that extend parallel to each other though and between the second terminal unit upper mounting surface 236*u* and the second terminal unit lower mounting surface 236*l*. The second terminal unit mounting block 236 also has a fuse receiving passageway 236*f* that extends though and between the second terminal unit upper mounting surface 236*u* and the second terminal unit lower mounting surface 236*l*. The fuse receiving passageway 236*f* is sized to receive the pair of fuse holders 68. Furthermore, the second terminal unit mounting block 236 has a pair of fuse clip terminal receiving holes 88 that are disposed between the second terminal unit upper mounting surface 236*u* and the second terminal unit lower mounting surface 236*l*. The pair of fuse clip terminal receiving holes 88 are in communication with the fuse receiving passageway 236*f*. Further, respective ones of the pair of fuse clip terminal receiving holes 88 are sized to slidably receive respective ones of the fuse clip terminals 84 so that the fuse clip terminals 84 project from the second terminal unit mounting block 236 as best shown in FIG. 17.

With reference to FIGS. 15-17, the shield cover 26 includes a pair of shield cover conduits 262. Each one of the pair of shield cover conduits 262 defines shield cover passageway 262*a* extending therethrough. The pair of shield cover conduits 262 are integrally connected to one of the first pair of side walls 26*b*. However, a skilled artisan would appreciate that any selected one of the first pair of side walls 26*b* and the second pair of side walls 26*c* could be chosen. Each one of the pair of shield cover passageways 262*a* is in communication with the cavity 30 as shown in FIG. 17 and is sized to receive one fuse clip terminal 84 and one distal second terminal assembly bus bar end 240*a*1 as best shown in FIG. 15.

Yet another exemplary embodiment of an electrical connector receptacle 310 of the present invention is hereinafter described with reference to FIGS. 18-21. The electrical connector receptacle 310 of the present invention is similar to the electrical connector receptacle 10 described above.

Figure 19:
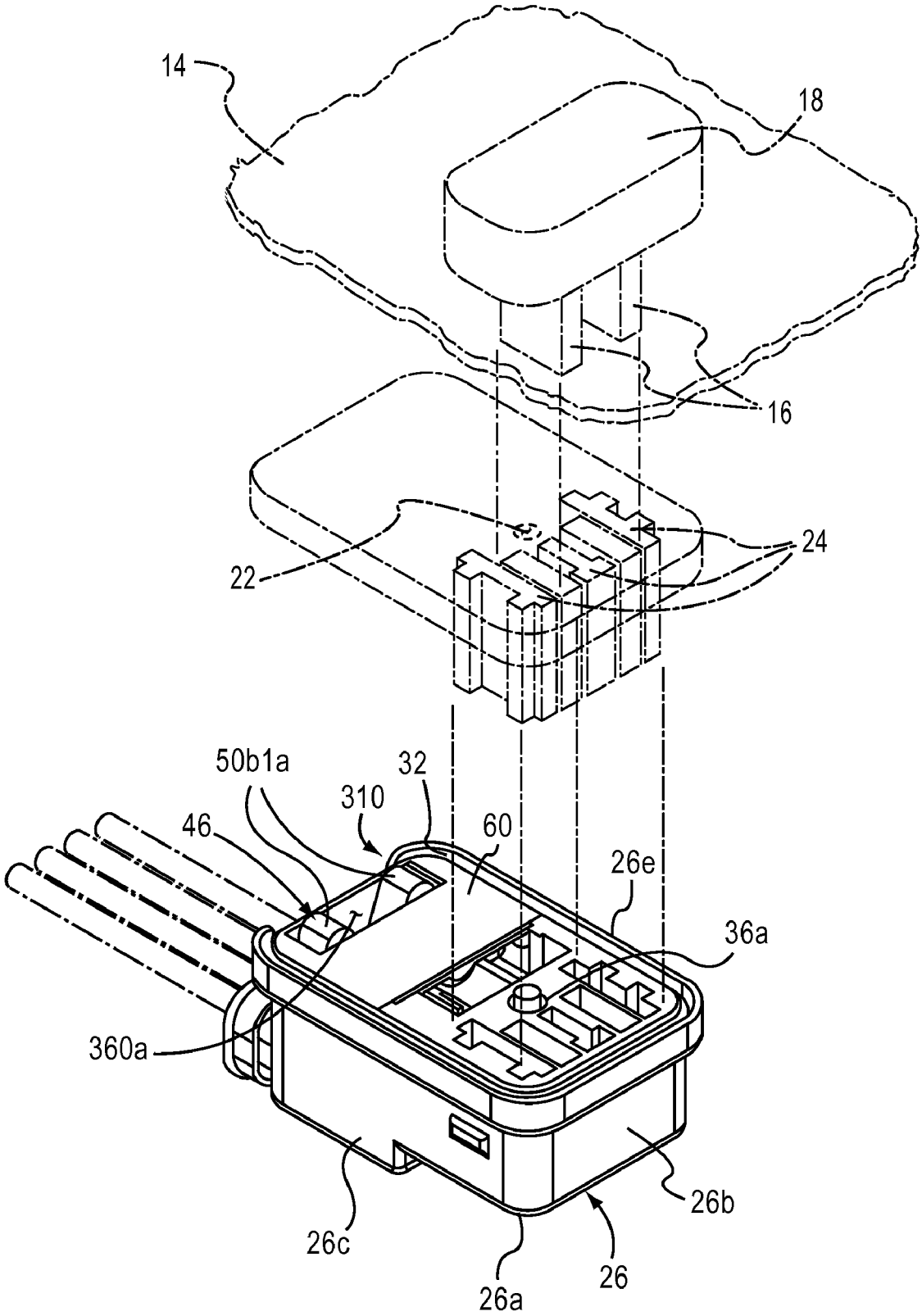
FIG. 19 is a bottom-up perspective view of the electrical connector receptacle shown in FIG. 18.
Figure 21:
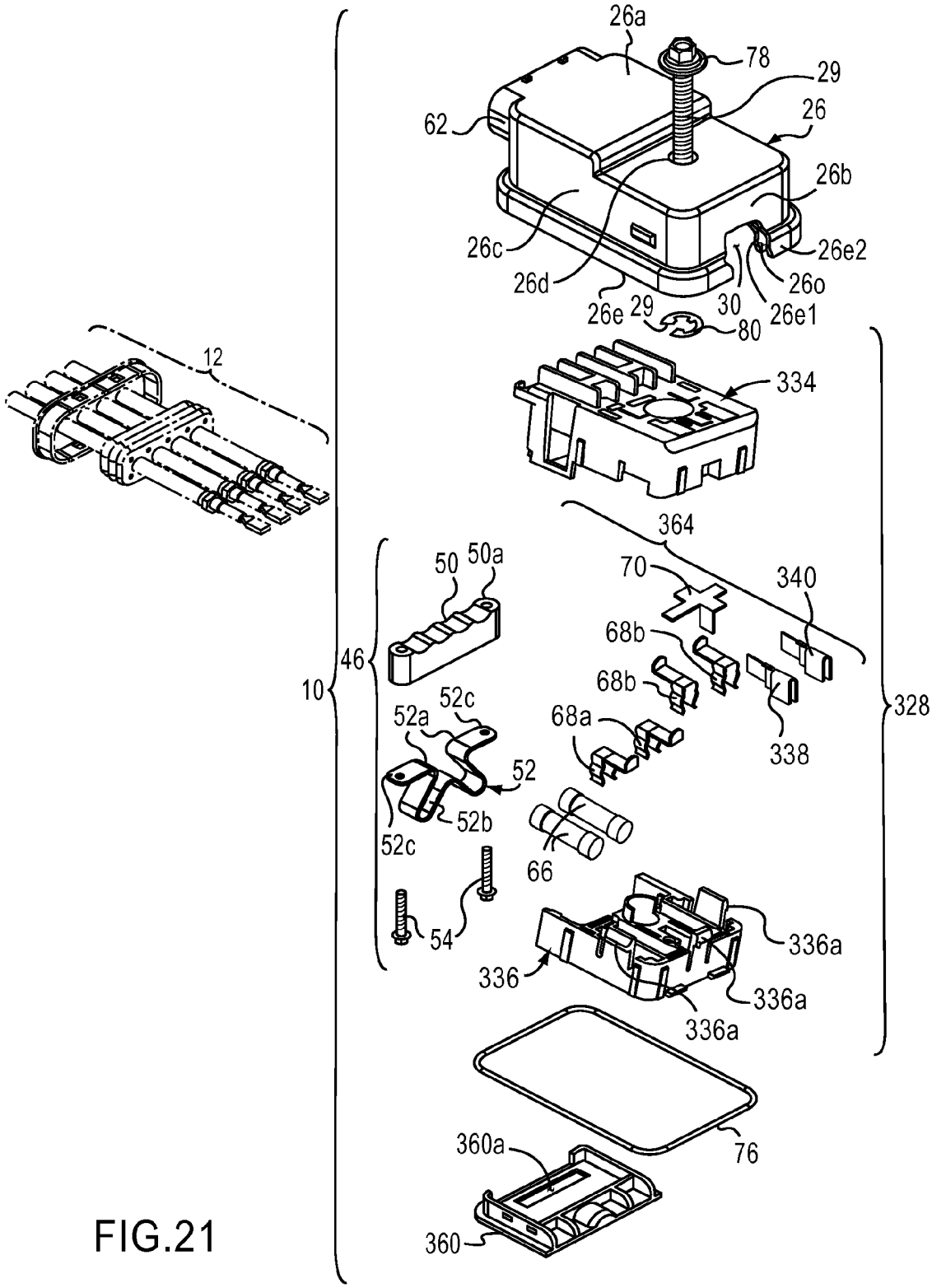
FIG. 21 is an exploded perspective view of the electrical connector receptacle in FIGS. 18 and 19.

As shown in FIGS. 19 and 21, a grounding assembly panel cover 360 has a grounding assembly panel cover hole 360*a* that is formed through the grounding assembly panel cover 360 in order to permit the portions 50*b*1*a* of the outwardly-projecting U-shaped sections 50*b*1 to project outwardly from the opening 32.

Figure 20:
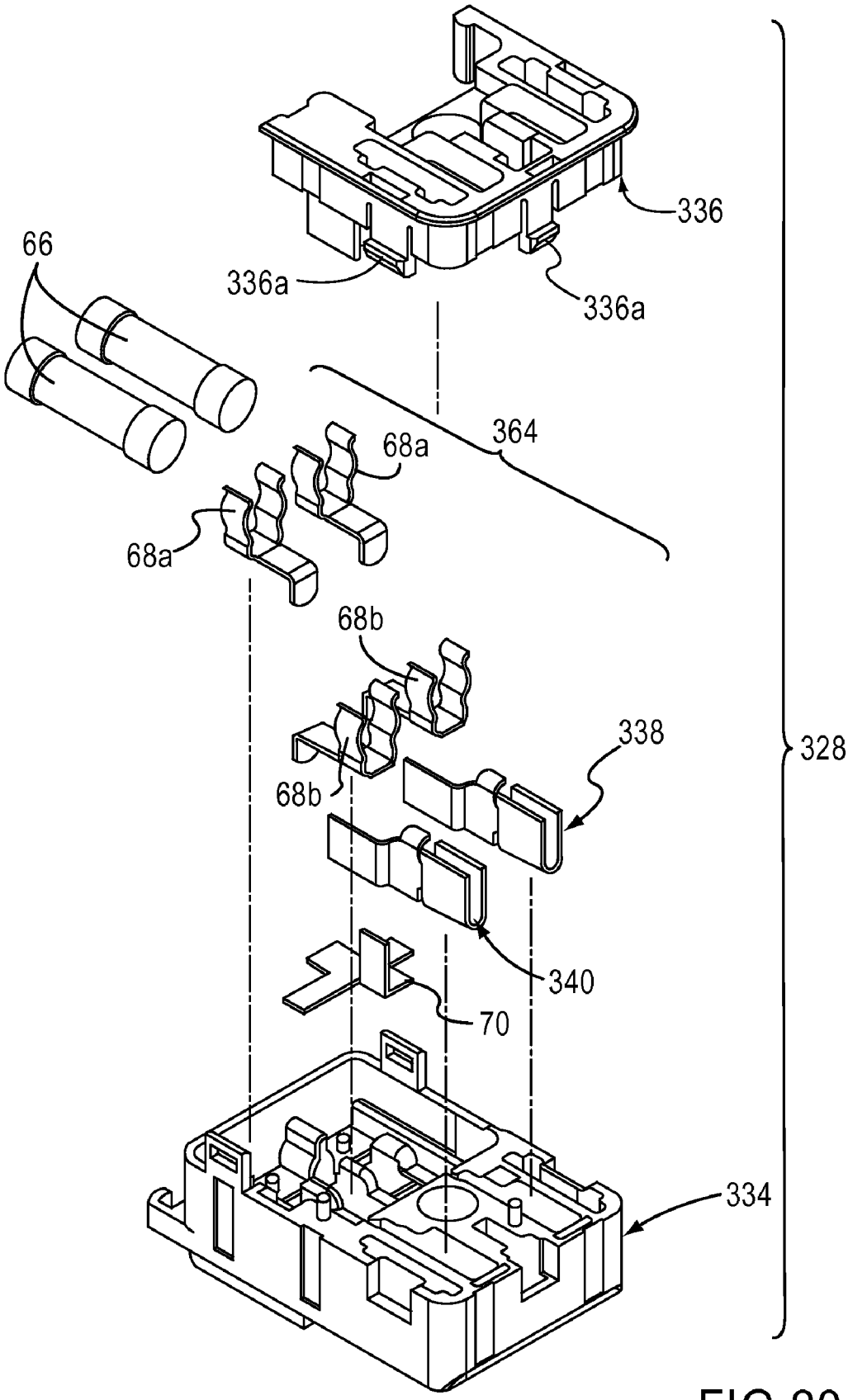
FIG. 20 is an exploded perspective view of a terminal unit of the electrical connector receptacle in FIGS. 18 and 19.

In FIGS. 20 and 21, a terminal unit 328 has a first terminal unit mounting lock 334, a second terminal unit mounting block 336, a first terminal assembly 338 and a second terminal assembly 340. Although by way of example only and not by way of limitation, the first and second terminal unit mounting blocks 334 and 336 respectively are ultrasonically welded together.

As shown in FIG. 20, a fuse assembly 364 is disposed between the first terminal unit mounting block 334 and the second terminal mounting block 336 and includes the pair of fuses 66, the two pairs of fuse holders 68*a* and 68*b* and the fuse clip bus bar 70. The fuse clip bus bar 70 electrically interconnects the fuse clips 68*b* and the first terminal assembly 338. A skilled artisan would appreciate that the fuse assembly 364 is disposed between the first and second terminal unit mounting blocks 334 and 336 and are nestled therein and connected therebetween when the first and second terminal unit mounting blocks 334 and 336 are ultrasonically welded together. Note in FIGS. 20 and 21, the second terminal unit mounting block 336 has a plurality of latch elements 336*a* that enable the assembled terminal unit 328 to be releasably connected to the shield cover 26, as is commonly known in the art.

The present invention, may, however, be embodied in various different forms and should not be construed as limited to the exemplary embodiments set forth herein; rather, these exemplary embodiments are provided so that this disclosure will be thorough and complete and will fully convey the scope of the present invention to those skilled in the art.

What is claimed is:

1. An electrical connector receptacle, comprising:

a shield cover fabricated from an electrically-conductive material and having a base panel, a first pair of opposing side walls connected to and depending from the base panel and a second pair of opposing side walls connected to and depending from the base panel and connected to the first pair of opposing side walls to define a cavity into the shield cover, the base panel having a base panel hole formed therethrough, the first and second pairs of opposing side walls connected together providing a peripheral side wall edge portion forming an opening into the cavity;

a terminal unit having a first terminal unit mounting block, a second terminal unit mounting block, a first terminal assembly and a second terminal assembly, the first terminal unit mounting block formed with a first terminal unit mounting block hole extending therethrough, the second terminal unit mounting block formed with a second terminal unit mounting block hole extending therethough, the first and second terminal unit mounting blocks being connected together in a stacked manner, respective ones of the first terminal assembly and the second terminal assembly mounted to at least one of the first terminal unit mounting block and the second terminal unit mounting block;

a fastener structure having a fastener head and an elongated shaft, wherein, with the first terminal unit mounting block hole and the second terminal unit mounting block hole being in registration with each other, the stacked, connected first and second terminal unit mounting blocks are disposed in the cavity and, with the first terminal unit mounting block hole, the second terminal unit mounting block hole and the base panel hole being in registration with one another, the fastener structure is operative in association with the shield cover and the terminal unit such that the fastener head is disposed exteriorly of the shield cover and facially opposes the base panel while the elongated shaft extends through the base panel hole, the first terminal unit mounting block hole and the second terminal unit mounting block hole and projects outwardly from the opening; and a grounding assembly sized to be received and releasably retained in the cavity, the grounding assembly including a yoke member being resiliently-biased and projecting outwardly from the opening when the grounding assembly is received and releasably retained in the cavity, the yoke member being fabricated from an electrically-conductive sheet material, wherein the grounding assembly includes a ground bar member fabricated from an electrically-conductive material and a pair of grounding assembly fasteners, the grounding bar member having a pair of grounding bar member holes extending therethrough, the yoke member having a pair of leg portions and a contact portion interconnecting the pair of leg portions, each leg portion having a leg portion hole formed therethrough.

2. An electrical connector receptacle according to claim 1, the ground bar member has a flat surface and an opposite scalloped surface, the pair of grounding bar member holes extending through and between the flat surface and the scalloped surface.

3. An electrical connector receptacle according to claim 1, wherein the first terminal unit mounting block and the second terminal unit mounting block are either releasably connected to each other or welded to each other.

4. An electrical connector receptacle according to claim 1, further comprising a fuse assembly connected to and disposed between the first terminal unit mounting block and the second terminal unit mounting block.

5. An electrical connector receptacle according to claim 1, wherein the contact portion includes a pair of outwardly-projecting U-shaped sections interconnected by an inwardly-projecting U-shaped section, respective ones of the pair of leg portions connected to respective ones of the outwardly-projecting U-shaped sections.

6. An electrical connector receptacle according to claim 5, further comprising a grounding assembly mounting block disposed in the cavity and integrally connected to the base panel, the grounding assembly mounting block having a pair of threaded grounding assembly mounting block holes disposed apart from one another, the grounding assembly mounting block and the grounding bar member associated with one another in a manner that respective ones of the pair of grounding bar member holes, the pair of threaded grounding assembly mounting block holes and the leg portion holes register with one another to receive respective ones of the grounding assembly fasteners for releasably connecting the grounding assembly and the shield cover to each other.

7. An electrical connector receptacle according to claim 6, wherein the first terminal unit mounting block includes a pair of eyelets disposed apart from one another and integrally formed with and project from the first terminal unit mounting block, respective ones of the pair of eyelets register with respective ones of the pair of grounding bar member holes, the pair of threaded grounding assembly mounting block holes and the leg portion holes register with one another to receive respective ones of the grounding assembly fasteners for releasably connecting the grounding assembly, the first terminal unit mounting block and the shield cover to each other with the pair of eyelets disposed between the grounding bar member and the grounding assembly mounting block.

8. An electrical connector receptacle according to claim 6, wherein, when the grounding assembly and the shield cover are releasably connected to each other, at least portions of the outwardly-projecting U-shaped sections project outwardly from the opening while the inwardly-projecting U-shaped section and the pair of leg portions are disposed interiorly of the cavity.

9. An electrical connector receptacle according to claim 8, further comprising a grounding assembly panel cover releasably connected to the shield cover within the cavity, the grounding assembly panel cover having a pair of grounding assembly panel cover holes formed therethrough to permit the at least portions of the outwardly-projecting U-shaped sections to project outwardly from the opening while covering the inwardly-projecting U-shaped section and the pair of leg portions.

10. An electrical connector receptacle according to claim 8, wherein the grounding assembly mounting block is disposed adjacent a selected one of the first pair and the second pair of side walls.

11. An electrical connector receptacle according to claim 10, wherein the shield cover includes at least one shield cover conduit defining at least one shield cover passageway extending therethrough, the at least shield cover conduit being integrally connected to the selected one of the first pair and second pair of side walls, the at least one shield cover passageway being in communication with the cavity.

12. An electrical connector receptacle according to claim 1, wherein at least one of the first terminal unit mounting block and the second terminal unit mounting block includes a pair of latch elements and at least a remaining one of the first terminal unit mounting block and a second terminal unit mounting block includes a pair of latch receiving holes sized and adapted to releasably receive respective ones of the pair of latch elements in order to releasably connect the first terminal unit mounting block and a second terminal unit mounting block together.

13. An electrical connector receptacle according to claim 12, wherein the first terminal unit mounting block has a first terminal unit upper mounting surface and an opposite first terminal unit lower mounting surface and the second terminal unit mounting block has a second terminal unit upper mounting surface and an opposite second terminal unit lower mounting surface, the first terminal unit upper mounting surface and the second terminal unit lower mounting surface being in facial contact with each other when the first terminal unit mounting block and a second terminal unit mounting block are releasably connected together, the first terminal unit upper mounting surface and the second terminal unit upper mounting surface disposed in the cavity and facing the opening.

14. An electrical connector receptacle comprising:

a shield cover fabricated from an electrically-conductive material and having a base panel, a first pair of opposing side walls connected to and depending from the base panel and a second pair of opposing side walls connected to and depending from the base panel and connected to the first pair of opposing side walls to define a cavity into the shield cover, the base panel having a base panel hole formed therethrough, the first and second pairs of opposing side walls connected together providing a peripheral side wall edge portion forming an opening into the cavity;

a terminal unit having a first terminal unit mounting block, a second terminal unit mounting block, a first terminal assembly and a second terminal assembly, the first terminal unit mounting block formed with a first terminal unit mounting block hole extending therethrough, the second terminal unit mounting block formed with a second terminal unit mounting block hole extending therethough, the first and second terminal unit mounting blocks being connected together in a stacked manner, respective ones of the first terminal assembly and the second terminal assembly mounted to at least one of the first terminal unit mounting block and the second terminal unit mounting block;

a fastener structure having a fastener head and an elongated shaft, wherein, with the first terminal unit mounting block hole and the second terminal unit mounting block hole being in registration with each other, the stacked, connected first and second terminal unit mounting blocks are disposed in the cavity and, with the first terminal unit mounting block hole, the second terminal unit mounting block hole and the base panel hole being in registration with one another, the fastener structure is operative in association with the shield cover and the terminal unit such that the fastener head is disposed exteriorly of the shield cover and facially opposes the base panel while the elongated shaft extends through the base panel hole, the first terminal unit mounting block hole and the second terminal unit mounting block hole and projects outwardly from the opening; and a fuse assembly disposed in the cavity, the fuse assembly being connected to the first terminal unit mounting block and including a pair of fuses, a pair of fuse holders and a fuse clip bus bar, each fuse holder having a live-side fuse clip and a dead-sided fuse clip disposed apart from one another at a distance sufficient to receive opposing electrically-conductive fuse end portions of one fuse, the fuse clip bus bar electrically interconnecting the live-side fuse clips and the first terminal member connector extension, wherein the first terminal assembly includes a first terminal member and a first terminal member connector extension electrically connected to the first terminal member.

15. An electrical connector receptacle according to claim 14, wherein the first terminal unit mounting block has a first terminal unit upper mounting surface and an opposite first terminal unit lower mounting surface, the first terminal unit upper mounting surface having a fuse assembly recess formed thereinto, the fuse assembly recess sized to matably receive and retain the pair of fuse holders therein.

16. An electrical connector receptacle according to claim 15, wherein the second terminal assembly includes a second terminal member, a second terminal member connector extension electrically connected to the second terminal member and a second terminal assembly bus bar electrically connected to the second terminal member connector extension.

17. An electrical connector receptacle according to claim 16, wherein the first terminal unit mounting block has a terminal member passageway extending through and between the first terminal unit upper mounting surface and the first terminal unit lower mounting surface, the first terminal unit lower mounting surface having a second terminal assembly bus bar recess formed thereinto, the second terminal assembly bus bar recess sized to matably receive and retain the second terminal assembly bus bar therein, the terminal member passageway sized to slidably receive the second terminal member from the first terminal unit lower mounting surface.

18. An electrical connector receptacle according to claim 17, wherein each one of the first and second terminal members is a female blade-receiving terminal having a female-blade receiving opening.

19. An electrical connector receptacle according to claim 18, wherein the second terminal unit mounting block has a second terminal unit upper mounting surface and an opposite second terminal unit lower mounting surface, the second terminal unit mounting block including a pair of terminal slots disposed apart from one another and extending to and between the second terminal unit upper mounting surface and the second terminal unit lower mounting surface, respective ones of the female-blade receiving openings being in registration and communication with respective ones the pair of terminal slots.

20. An electrical connector receptacle according to claim 19, wherein the second terminal unit mounting block has a first key hole and a second key hole being configured differently from the first key hole, the first and second key holes extending to and between the second terminal unit upper mounting surface and the second terminal unit lower mounting surface.

21. An electrical connector receptacle according to claim 20, wherein the second terminal unit mounting block has a third key hole extending to and between the second terminal unit upper mounting surface and the second terminal unit lower mounting surface, the third key hole being configured differently from the first and second key holes, the third key hole being disposed between the pair of terminal slots, the third key hole and the pair of terminal slots being disposed between the first and second key holes.

22. An electrical connector receptacle according to claim 21, wherein the first terminal unit mounting block has a fourth key hole and a fifth key hole being configured differently from the fourth key hole, the fourth and fifth key holes extending to and between the first terminal unit upper mounting surface and the first terminal unit lower mounting surface, the fourth key hole configured identically to and aligned in registration with the first key hole, the fifth key hole being configured identically to and aligned in registration with the second key hole.

23. An electrical connector receptacle according to claim 22, wherein the first terminal unit mounting block has a sixth key hole extending to and between the first terminal unit upper mounting surface and the first terminal unit lower mounting surface, the sixth key hole being configured differently from the fourth and fifth key holes, the sixth key hole being disposed between the fourth and fifth key holes, the sixth key hole being configured identically to and aligned in registration with the third key hole.

24. An electrical connector receptacle, comprising:

a shield cover fabricated from an electrically-conductive material and having a base panel, a first pair of opposing side walls connected to and depending from the base panel and a second pair of opposing side walls connected to and depending from the base panel and connected to the first pair of opposing side walls to define a cavity into the shield cover, the base panel having a base panel hole formed therethrough, the first and second pairs of opposing side walls connected together providing a peripheral side wall edge portion forming an opening into the cavity;

a terminal unit having a first terminal unit mounting block, a second terminal unit mounting block, a first terminal assembly and a second terminal assembly, the first terminal unit mounting block formed with a first terminal unit mounting block hole extending therethrough, the second terminal unit mounting block formed with a second terminal unit mounting block hole extending therethough, the first and second terminal unit mounting blocks being connected together in a stacked manner, respective ones of the first terminal assembly and the second terminal assembly mounted to at least one of the first terminal unit mounting block and the second terminal unit mounting block; and a fastener structure having a fastener head and an elongated shaft, wherein, with the first terminal unit mounting block hole and the second terminal unit mounting block hole being in registration with each other, the stacked, connected first and second terminal unit mounting blocks are disposed in the cavity and, with the first terminal unit mounting block hole, the second terminal unit mounting block hole and the base panel hole being in registration with one another, the fastener structure is operative in association with the shield cover and the terminal unit such that the fastener head is disposed exteriorly of the shield cover and facially opposes the base panel while the elongated shaft extends through the base panel hole, the first terminal unit mounting block hole and the second terminal unit mounting block hole and projects outwardly from the opening, wherein the peripheral side wall edge portion includes an inner peripheral side wall extending circumferentially about the shield cover and an outer peripheral side wall connected to and disposed apart and outwardly from the inner peripheral side wall to define a shield cover O-ring receiving channel therebetween, the outer peripheral side wall extending along at least the first pair of side walls and one of the pair of second side walls.

25. An electrical connector receptacle according to claim 24, wherein the outer peripheral side wall extends partially along a remaining one of the pair of second side walls.

26. An electrical connector receptacle according to claim 24, further comprising an shield cover O-ring sized and adapted to be received by the O-ring receiving channel.

27. An electrical connector receptacle, comprising:

a shield cover fabricated from an electrically-conductive material and having a base panel, a first pair of opposing side walls connected to and depending from the base panel and a second pair of opposing side walls connected to and depending from the base panel and connected to the first pair of opposing side walls to define a cavity into the shield cover, the base panel having a base panel hole formed therethrough, the first and second pairs of opposing side walls connected together providing a peripheral side wall edge portion forming an opening into the cavity;

a terminal unit having a first terminal unit mounting block, a second terminal unit mounting block, a first terminal assembly and a second terminal assembly, the first terminal unit mounting block formed with a first terminal unit mounting block hole extending therethrough, the second terminal unit mounting block formed with a second terminal unit mounting block hole extending therethough, the first and second terminal unit mounting blocks being connected together in a stacked manner, respective ones of the first terminal assembly and the second terminal assembly mounted to at least one of the first terminal unit mounting block and the second terminal unit mounting block; and a fastener structure having a fastener head and an elongated shaft, wherein, with the first terminal unit mounting block hole and the second terminal unit mounting block hole being in registration with each other, the stacked, connected first and second terminal unit mounting blocks are disposed in the cavity and, with the first terminal unit mounting block hole, the second terminal unit mounting block hole and the base panel hole being in registration with one another, the fastener structure is operative in association with the shield cover and the terminal unit such that the fastener head is disposed exteriorly of the shield cover and facially opposes the base panel while the elongated shaft extends through the base panel hole, the first terminal unit mounting block hole and the second terminal unit mounting block hole and projects outwardly from the opening, wherein the fastener structure includes at least one fastener O-ring and a fastener retainer clip, the at least one fastener O-ring surrounding the elongated shaft adjacent the fastener head, the fastener retainer clip connected to the elongated shaft adjacent the at least one fastener O-ring with the at least one fastener O-ring being disposed between the fastener head and the fastener retainer clip, when the fastener structure is operative in association with the shield cover and the terminal unit, the at least one fastener O-ring is disposed exteriorly of the shield cover and the fastener retainer clip is disposed in the cavity between the shield cover and the terminal unit.

28. An electrical connector receptacle, comprising:

a shield cover fabricated from an electrically-conductive material and having a base panel, a first pair of opposing side walls connected to and depending from the base panel and a second pair of opposing side walls connected to and depending from the base panel and connected to the first pair of opposing side walls to define a cavity into the shield cover, the base panel having a base panel hole formed therethrough, the first and second pairs of opposing side walls connected together providing a peripheral side wall edge portion forming an opening into the cavity;

a terminal unit having a first terminal unit mounting block, a second terminal unit mounting block, a first terminal assembly and a second terminal assembly, the first terminal unit mounting block formed with a first terminal unit mounting block hole extending therethrough, the second terminal unit mounting block formed with a second terminal unit mounting block hole extending therethough, the first and second terminal unit mounting blocks being connected together in a stacked manner, respective ones of the first terminal assembly and the second terminal assembly mounted to at least one of the first terminal unit mounting block and the second terminal unit mounting block;

a fastener structure having a fastener head and an elongated shaft, wherein, with the first terminal unit mounting block hole and the second terminal unit mounting block hole being in registration with each other, the stacked, connected first and second terminal unit mounting blocks are disposed in the cavity and, with the first terminal unit mounting block hole, the second terminal unit mounting block hole and the base panel hole being in registration with one another, the fastener structure is operative in association with the shield cover and the terminal unit such that the fastener head is disposed exteriorly of the shield cover and facially opposes the base panel while the elongated shaft extends through the base panel hole, the first terminal unit mounting block hole and the second terminal unit mounting block hole and projects outwardly from the opening; and a fuse assembly disposed in the cavity, the fuse assembly being connected to the first terminal unit mounting block and including a pair of fuses, a pair of fuse holders and a fuse clip bus bar, each fuse holder having a live-side fuse clip and a dead-sided fuse clip disposed apart from one another at a distance sufficient to receive opposing electrically-conductive fuse end portions of one fuse, the fuse clip bus bar electrically interconnecting the live-side fuse clips and the first terminal member connector extension, each dead-side fuse clip having a fuse clip terminal extending therefrom, and wherein the first terminal unit mounting block has a first terminal unit upper mounting surface and an opposite first terminal unit lower mounting surface, the first terminal unit upper mounting surface having terminal receiving cavity formed thereinto and a pair of terminal slots disposed between the first terminal unit upper mounting surface and the first terminal unit lower mounting surface and in communication with the terminal receiving cavity, the fuse assembly recess sized to matably receive and retain the pair of fuse holders therein, the second terminal assembly includes a second terminal member and a pair of elongated second terminal assembly bus bars electrically connected to the second terminal member and extending parallel to the fuse clip terminals, respective ones of the pair of second terminal assembly bus bars being received in respective ones of the pair of terminal slots with distal second terminal assembly bus bar ends projecting from the first terminal unit mounting block.

29. An electrical connector receptacle according to claim 28, wherein the second terminal unit mounting block has a second terminal unit upper mounting surface and an opposite second terminal unit lower mounting surface, a pair of terminal receiving passageways extending parallel to each other though and between the second terminal unit upper mounting surface and the second terminal unit lower mounting surface, a fuse receiving passageway extending though and between the second terminal unit upper mounting surface and the second terminal unit lower mounting surface and sized to receive the pair of fuse holders and a pair of fuse clip terminal receiving holes disposed between the second terminal unit upper mounting surface and the second terminal unit lower mounting surface and in communication with the fuse receiving passageway, respective ones of the pair of fuse clip terminal receiving holes sized to slidably receive respective ones of the fuse clip terminals so that the fuse clip terminals project from the second terminal unit mounting block.

30. An electrical connector receptacle according to claim 29, wherein the shield cover includes a pair of shield cover conduits, each one of the pair of shield cover conduits defining shield cover passageway extending therethrough, the pair of shield cover conduits being integrally connected to a selected one of the first pair and second pair of side walls, each one of the pair of shield cover passageways being in communication with the cavity and sized to receive one fuse clip terminal and one distal second terminal assembly bus bar end.

31. An electrical connector receptacle, comprising:

a shield cover fabricated from an electrically-conductive material and having a base panel, a first pair of opposing side walls connected to and depending from the base panel and a second pair of opposing side walls connected to and depending from the base panel and connected to the first pair of opposing side walls to define a cavity into the shield cover, the base panel having a base panel hole formed therethrough, the first and second pairs of opposing side walls connected together providing a peripheral side wall edge portion forming an opening into the cavity;

a terminal unit having a first terminal unit mounting block, a second terminal unit mounting block, a first terminal assembly and a second terminal assembly, the first terminal unit mounting block formed with a first terminal unit mounting block hole extending therethrough, the second terminal unit mounting block formed with a second terminal unit mounting block hole extending therethough, the first and second terminal unit mounting blocks being connected together in a stacked manner, respective ones of the first terminal assembly and the second terminal assembly mounted to at least one of the first terminal unit mounting block and the second terminal unit mounting block; and a fastener structure having a fastener head and an elongated shaft, wherein, with the first terminal unit mounting block hole and the second terminal unit mounting block hole being in registration with each other, the stacked, connected first and second terminal unit mounting blocks are disposed in the cavity and, with the first terminal unit mounting block hole, the second terminal unit mounting block hole and the base panel hole being in registration with one another, the fastener structure is operative in association with the shield cover and the terminal unit such that the fastener head is disposed exteriorly of the shield cover and facially opposes the base panel while the elongated shaft extends through the base panel hole, the first terminal unit mounting block hole and the second terminal unit mounting block hole and projects outwardly from the opening, wherein the second terminal unit mounting block includes a plurality of latch elements operative to releasably connect the terminal unit to the shield cover.

* * * * *